US007241544B2

(12) United States Patent
Ohmura et al.

(10) Patent No.: US 7,241,544 B2
(45) **Date of Patent: *Jul. 10, 2007**

(54) IMAGE FORMING METHOD

(75) Inventors: Ken Ohmura, Hachioji (JP); Naohiro Hirose, Hachioji (JP); Asao Matsushima, Hachioji (JP); Shiro Hirano, Hachioji (JP)

(73) Assignee: Konica Minolta Holdings, Inc., Tokyo (JP)

( * ) Notice: Subject to any disclaimer, the term of this patent is extended or adjusted under 35 U.S.C. 154(b) by 376 days.

This patent is subject to a terminal disclaimer.

(21) Appl. No.: 10/823,341

(22) Filed: Apr. 12, 2004

(65) Prior Publication Data

US 2005/0226661 A1 Oct. 13, 2005

(51) Int. Cl.
*G03G 9/00* (2006.01)

(52) U.S. Cl. ..... 430/108.3; 430/120

(58) Field of Classification Search ..... 430/108.3, 430/120

See application file for complete search history.

(56) References Cited

U.S. PATENT DOCUMENTS

| | | | | |
|---|---|---|---|---|
| 6,153,346 | A | 11/2000 | Maehata | |
| 6,485,878 | B2 | 11/2002 | Nagase | |
| 6,821,695 | B2 * | 11/2004 | Matsushima et al. | 430/108.1 |
| 2003/0129519 | A1 * | 7/2003 | Ishibashi et al. | 430/137.14 |

FOREIGN PATENT DOCUMENTS

| | | |
|---|---|---|
| JP | 08-305077 | 11/1996 |
| JP | 11-311877 | 11/1999 |
| JP | 2000-330330 | 11/2000 |
| JP | 2001-060050 | 3/2001 |
| JP | 2001-281927 | 10/2001 |

* cited by examiner

*Primary Examiner*—Mark A. Chapman
(74) *Attorney, Agent, or Firm*—Lucas & Mercanti, LLP

(57) ABSTRACT

An image forming method comprises: fixing an image formed by a toner on a record sheet in a nip member formed by a pressurizing member which is compressibly contacted against a heating fixing rotor having an elastic body layer formed on an endless periphery surface capable of orbitally moving and which creates locally a large distortion occurred in the elastic body layer in vicinity of outlet thereof, wherein the toner includes at least two metal salts having different valence and has a relationship given by the Formula (1).

$$2.0 \geqq a \geqq 0.1$$

$$1.0 \geqq b \geqq 0.01$$

$$7.5 \geqq a/b \geqq 1.1 \qquad \text{Formula (1)}$$

wherein a (mass %) is defined as a content of a metal salt which is contained at a highest content in total toner mass and b (mass %) is defined as a content of a metal salt which is contained at a second-highest content in the total toner mass, and mass values of a and b represent anhydride reduced values.

14 Claims, 2 Drawing Sheets

IMAGE FORMING METHOD

BACKGROUND

1. Technical Field

The present invention relates to an image forming method, which is applicable to a photocopying machine, a printer, a facsimile equipment or the like, and in which an electrostatic latent image is formed on an image support member, and the formed electrostatic latent image is developed with toner, and pictorial image is formed.

2. Description of Related Art

Conventionally, in the copying machine which utilizes an electrophotography process, it is necessary to fix an unfixed toner image formed on the recording sheet to form an eternity image, and a heating roller fixing method conducted by the heating and the pressurization is a general fixing method. That is, a known apparatus is a heating roller type fixing apparatus, which comprises: a heating roller which comprises a heater lamp within a cylindrical core metal and a heat resistant releasing layer formed on the outer surface thereof; and a pressure roller which is disposed in a compressibly contacting manner against this heating roller (fixing roll), and comprises a heat-resistant elastic body layer formed on outer surface of the cylindrical core metal, wherein a fixing process is conducted by applying a constant pressure between both these rollers and inserting therebetween a support member such as normal paper on which an unfixed toner image is formed. Because the heating roller type fixing apparatus used for this system has higher thermal efficiency, in comparison with other heating fixing methods such as a flash fixing system and an oven fixing system, and thus requires lower electric power, provides better processing speed, and also provides lower fire-hazardous nature caused by a paper jam, the heating roller type fixing apparatus is the most popular system at the present time.

However, since the fixing apparatus of the heating roller fixing system using the heating roller (rotating part materials for fixing) requires to heat the heating roller for fixing having larger heat capacity, when transference materials and the toner are heated with the heating roller having halogen heater therein, it is disadvantageous for the energy conservation effect, and thus it provides poor energy conservation, and further, since time consumes for warming up the fixing apparatus in a printing process, there is problem of requiring longer printing time (warming up time).

In recent years, there is a demand for increasing the fixing rate in such heating roller type fixing apparatus, and in order to satisfy the demand, the width of the nip region, or in other words the nip width, is required to be increased. Here, methods for increasing the nip width include a method for increasing the load exerted between these rollers, or a method for increasing roller diameter of both the fixing roller and the pressure roller, or the like. However, there is a limitation in the available fixing rate that can correspond with these methods, and in order to apply for the higher fixing rate region, a heating roller belt type fixing apparatus is developed.

Pressurizing belts employed for the heating roller belt type fixing apparatus as mentioned above may mainly and be classified into two types of belts, in general. More specifically, the belts are classified into:

1) fluorine resin-coated belt, which is formed by coating the base film of endless belt shape with an adhesive referred to as "primer", and thereafter thinly coating thereof with a fluorine resin such as polytetrafluoroethylene (PTFE) or copolymer of tetrafluoroethylene and perfluoroethylene (PFA) and so on; and
2) silicone rubber coating belt or fluorine-containing rubber coating belt, which is formed by thinly coating the base film having endless belt shape with silicone rubber or fluorine-containing rubber via a primer therebetween.

As the fixing system that employs the metal belt (belt member) having the above mentioned rubber layer, and has an exothermic roller (exothermic roller member), which heats the belt member and provided in the inside of belt member, is disclosed in, for example, JP-Tokukai 2000-267356, JP-Tokukai 2000-60050 and JP-Tokukai 09-138599.

However, the above-mentioned proposed fixing apparatus, which uses endless belt, has a drawback of having lower fixing strength due to its lower fixing load (pressurization) as compared with the heating roller system, and among other things, there are various problems of varying the fixing strength depending on the types of the toner and the transfer paper, and thus it is the present situation that does not reach to apply the fixing apparatus containing this system to the application of a high speed printer and a high speed photocopying machine.

Furthermore, since the above-mentioned fixing system involves heating the toner image, a minor constituent included in the toner is released into the atmosphere, and there is a case, which causes an unpleasant odor for the users. More in recent years, accompanying with the reduction of the size of the photocopying machine and the printer, opportunity of using them with intimacy becomes increasingly in offices. In addition, the opportunity of using such machines in general families have been increased, and as a result, the case, in which odor emitted from the toner gives an unpleasant feeling to the user, increases more often than conventional.

SUMMARY

In accordance with the first aspect of the present invention, an image forming method comprises: fixing an image formed by a toner on a record sheet in a nip area formed by a pressurizing member which is compressibly contacted against a heating fixing rotor having an elastic body layer formed on an endless periphery surface capable of orbitally moving and which creates locally a large distortion occurred in the elastic body layer in vicinity of outlet thereof, wherein the toner includes at least two metal salts having different valence and has a relationship given by the Formula (1).

$$2.0 \geqq a \geqq 0.1$$

$$1.0 \geqq b \geqq 0.01$$

$$7.5 \geqq a/b \geqq 1.1 \qquad \text{Formula (1)}$$

wherein a (mass %) is defined as a content of a metal salt which is contained at a highest content in total toner mass and b (mass %) is defined as a content of a metal salt which is contained at a second-highest content in the total toner mass, and mass values of a and b represent anhydride reduced values.

In accordance with the second aspect of the present invention, an image forming method comprises: fixing an image formed by a toner on a record sheet in a nip area formed by a pressurizing member which is compressibly contacted against a heating fixing rotor having an elastic body layer formed on an endless periphery surface capable of orbitally moving and which creates locally a large distortion occurred in the elastic body layer in vicinity of outlet thereof, wherein the toner is one manufactured by salting out/fusing resin particles.

By use of the first and second aspects of the present invention, a image forming method having wider range of temperature available for toner fixing, better anti-offset, longer duration life of the fixing member and reduced odor emitted in the fixing process can be provided.

BRIEF DESCRIPTION OF THE DRAWINGS

The present invention will become more fully understood from the detailed description given hereinbelow and the accompanying drawings which are given by way of illustration only, and thus are not intended as a definition of the limits of the present invention, and wherein.

DETAIL DESCRIPTION OF EXEMPLARY EMBODIMENTS

Figure 1:
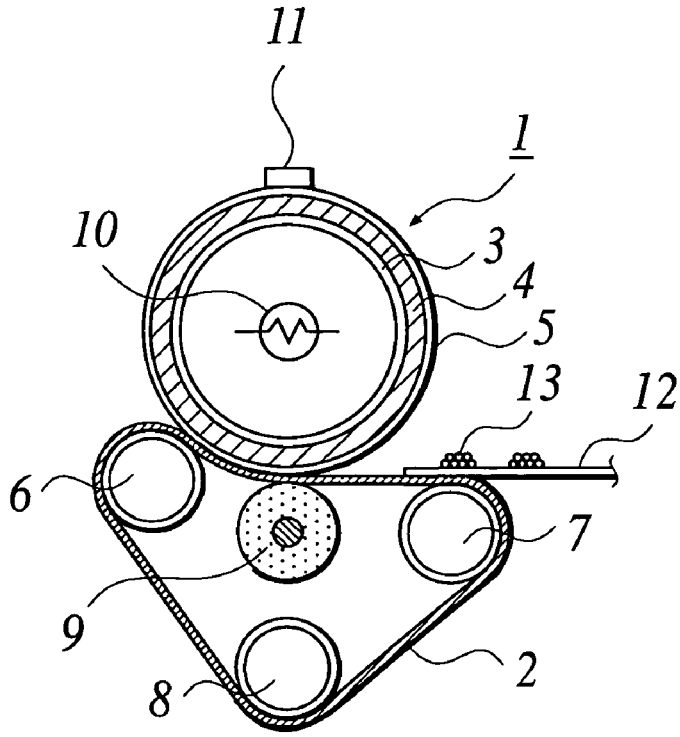
FIG. 1 is a schematic diagram showing an example of a fixing apparatus having an endless belt that it is available to be employed in the present invention.

The embodiment of the present invention will be hereinafter described in details.

The present inventors actively involved the investigations to address the above problems, and the results of the investigation indicate that an image forming method for heating and pressurizing a toner image on a record sheet and fixing the image on the record sheet formed by adhering a toner onto the electrostatic latent image by electrostatic potential difference in a nip area formed by a pressurizing member which is compressibly contacted against a heating fixing rotor having an elastic body layer formed on an endless periphery surface capable of orbitally moving and which creates locally a large distortion occurred in the elastic body layer of the heating fixing rotor in vicinity of outlet thereof, wherein the toner includes at least two metal salts having different valence and a (mass %) is defined as a content of a metal salt which is contained at a highest content in the total toner mass and b (mass %) is defined as a content of a metal salt which is contained at a second-highest content in the total toner mass, and the inventors finally provide higher oozing efficiency of the mold releasing agent and higher fixing rate, even if fixing load is low, and thus the present inventors achieved to complete the present invention by using the toner in which a and b satisfies a relationship given by the Formula (1), the toner manufactured by salting out/fusing resin particles, or the toner manufactured by salting out/fusing resin particles and manufactured by a step of forming particles within a water-type medium and a step of eliminating odor.

The resin particle according to the present invention is set out for a resin particle produced by emulsion polymerization, mini-emulsion polymerization or the like as will be described later. The mold releasing agent may preferably be an agent contained in the resin particle, but may be toner particles formed by simultaneously salting out/fusing the resin particle and the mold releasing agent particle. Because salts are uniformly and rarely exist in the toner manufactured by salting out/fusing, the electrostatic offset is not often generated. In particular, duration life of the fixing member is considerably improved by employing the fixing apparatus having a configuration of a surface layer of a heating fixing rotor having an endless periphery surface capable of orbitally moving, in which an elastic body layer is formed on the endless periphery surface, is a vulcanizate of a fluorine-containing rubber, which contains 3 to 50 parts by mass of lower molecular weight-tetra ethylene fluoride resin fine particle or polyfluoroalkylvinylether (PFA) resin fine particle per 100 parts by mass of fluorine-containing rubber.

In addition in general, the emulsion polymerization toner involves an odor problem in the fixing processing, and in particular in the fixing apparatus which uses an endless belt having an endless periphery surface capable of orbitally moving, much odor is generated, since the contact heating time or so-called fixing nip passing time is long. Therefore, it is preferable to provide with an odor elimination step for the manufacturing process of the toner used in the fixing apparatus having endless belt. The odor elimination step, which will be discussed later more specifically, employs adding a chemical deodorizer such as enzyme, plant extraction component or the like or adding of odorant/masking reagent.

Details of the present invention will be described as follows.

The image forming method of the present Invention forms an electrostatic latent image on an image support member and adheres by a development apparatus a toner onto the electrostatic latent image formed on the image support member to form a toner image, before forms a pressurizing member by compressibly contacting it against the heating fixing rotor in which an elastic body layer is formed on an endless periphery surface capable of orbitally moving and transfers into a nip area creating locally a large distortion occurred in the elastic body layer of the heating fixing rotor in vicinity of outlet thereof a record sheet on which the toner image has been copied or a record sheet on which the toner image will be copied and fixed in the nip member.

In order to achieve the above described image forming method, one of the characteristics of the present invention is to employ: a heating and fixing rotor having an endless periphery surface capable of orbitally moving as a fixing and transfer device and having an elastic body layer formed on the endless periphery surface; a pressurizing member having a nip area formed by being compressibly contacted against the heating fixing rotor, the pressurizing member creating locally a large distortion occurred in the elastic body layer in vicinity of outlet of the nip area; and transfer device for transferring into the nip area a record sheet, on which the toner image has been copied or on which the toner image will be copied and fixed in the nip area.

First, the fixing apparatus according to the present invention will be described.

Although examples of the fixing apparatus having the endless belt that is available to be employed in the present invention will be shown as follows, it is not intended to limit the scope of the present invention thereto.

FIG. 1 is a schematic diagram showing an example of a fixing apparatus having an endless belt that it is available to be employed in the present invention.

In FIG. 1, the fixing apparatus mainly comprises a heating roller 1 having a heat source therein, an endless belt 2 that is arranged to be compressibly contacted against the heating roller 1, a pressure roller 6 that stretches the endless belt 2 and two support rollers 7 and 8, and a pressure support roller 9 that pressurizes endless belt 2 against the pressure roller 6 to form a nip area.

The heating roller 1 is constituted by forming an elastic body layer 4 and a releasing layer 5 in the periphery of the metal core 3, and the core 3 is composed of a cylindrical body of, for example, iron, aluminum, SUS or the like. An elastic body layer 4 is provided on the surface of the core 3. An elastic body having higher heat resistivity can be employed for the elastic body layer 4, and for example, HTV (High Temperature Vulcanization) silicone rubber having a rubber hardness 45° (JIS-A) can be formed with a desired thickness, or other material can also be used. A releasing layer 5 is provided on the elastic body layer, and for example, in addition to RTV (Room Temperature Vulcanization) silicone rubber, a fluorine-containing rubber such as Viton or a fluorine resin such as PFA (perfluoroalkoxyvinylether copolymer resin), PTFE (polytetrafluoroethylene), FEP (tetrafluoroethylene hexafluoropropylene copolymer resin) or the like can be employed to coat thereon, and for example, these releasing layer can be formed using a method such as dip-coating or a method for coating by using a tube.

Further, for example, metals such as aluminum or SUS can be used for the core 3, in addition to iron. For the releasing layer 5, in addition to silicone rubber, a fluorine-containing rubber such as Viton or the like, or a fluorine resin such as PFA (perfluoroalkoxyvinylether copolymer resin), PTFE (polytetrafluoroethylene), FEP (tetrafluoroethylene hexafluoropropylene copolymer resin) or the like may be employed to coat thereon.

A heating element 10 such as a halogen lamp, for example, is fixed and supported as a heat source within the core 3. In addition, a temperature sensor 11 is disposed in vicinity of the surface of the heating roller 1 to measure the surface temperature of the heating roller. In addition, based on the instrumentation signal of the temperature sensor 11, the heating element 10 is feedback-controlled by the temperature controller, which is not shown, to control the surface of the heating roller 1 to be a predetermined temperature.

A releasing agent feeder is disposed in vicinity of the heating roller 1. A constant quantity of a mold releasing agent is always supplied to the surface of the heating roller 1 from the releasing agent feeder. This prevents a part of toner offset on the heating roller 1 when the unfixed toner is fixed onto the record sheet. The available mold releasing agent supplied from the releasing agent feeder may be, for example, dimethyl silicone oil (commercially available from Shin-Etsu chemical Co., Ltd. under the trade name of "KF-96").

The endless belt 2 that is a heating fixing rotor formed of the elastic body layer on the endless periphery surface is, for example, a film having desired thickness and periphery length such as, for example, a base member of polyimide film or the like, which is, for example, coated with silicone rubber to a thickness of about 30 μm as a releasing layer. The method of coating may be a method of applying a releasing layer onto the base member surface, or a method of coating a tube-shaped releasing layer material onto the base member. The endless belt 2 is stretched with a constant tensile force around the peripheries of the pressure roller 6 and the support rollers 7 and 8. The pressure roller 6 and the support rollers 7 and 8 are mainly formed of stainless steel. Among these, the pressure roller 6 is pressurized toward the center of the heating roller 1 with a desired load, and this forces the endless belt 2 compressibly contacting the heating roller 1 so that the endless belt 2 is wound up by the heating roller 1. Nip width (a die length in transportation direction of the record sheet) of this embodiment is around 20 mm, in general.

Figure 2:
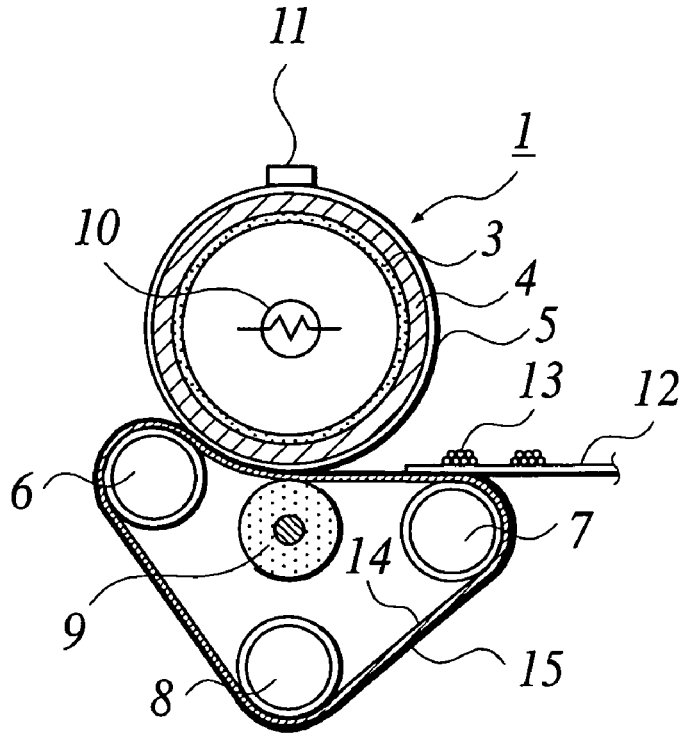
FIG. 2 is a schematic diagram showing another example of a fixing apparatus having an endless belt that it is available to be employed in the present invention.

One of the characteristics of the invention according to claim 3 is, as shown in FIG. 2, to have a surface layer 15 of a vulcanizate of fluorine-containing rubber composition additionally containing 3 to 50 parts by mass of lower molecular weight tetrafluoroethylene resin fine particles or polyfluoroalkylvinylether (PFA) resin particles over 100 parts by mass of fluorine-containing rubber on the endless belt surface formed on the endless periphery surface top by the elastic body layer 14, and in addition, the invention according to claim 4 is characterized in that the surface layer 15 of heating fixing rotor is provided with a polyfluoroalkylvinylether (PFA) layer formed on silicone rubber which is the elastic body layer 14.

Polyfluoroalkylvinylether (PFA) may preferably be a copolymer of tetrafluoroethylene and at least one of fluoro (alkyl vinyl ether) shown by $CF_2{=}CF{-}O{-}Rf$ (Rf represents fluoroalkyl group of carbon number 1 to 10 in the formula), and preferably, PFA consists of 99 to 92 mass % of tetrafluoroethylene and 1 to 8 mass % of fluoro (alkyl vinyl ether). In addition, tetrafluoroethylene hexafluoropropylene copolymer (FEP) preferably consists of 96 to 87 mass % of tetrafluoroethylene and 4 to 13 mass % of hexafluoropropylene. Tetrafluoroethylene ethylene copolymer (ETFE) preferably consists of 90 to 74 mass % of tetrafluoroethylene 10 to 26 mass % and ethylene. ECTFE preferably consists of 68 to 14 mass % of ethylene and 32 to 86 mass % of chlorotrifluoroethylene.

On the other hand, the pressure support roller 9 disposed in the upstream side of the transporting direction of the record sheet 12 (or also referred to as a base member) having toner 13 thereon against the pressure roller 6 is formed by, for example, coating a stainless steel core with a silicone sponge (silicone rubber foam). The pressure support roller 9 is pressurized with a constant load from the inside of the endless belt 2 toward the center direction of the heating roller 1. However, since the pressure support roller 9 is formed with a material, which is softer than the elastic body layer 4 of heating roller 1, the sponge layer of the pressure support roller 9 transforms, and almost no distortion occurs in heating roller 1.

The heating roller 1 is driven to rotate at a suitable circumferential speed by the motor that is not shown, and the endless belt 2 is also driven to rotate at almost same speed by this revolution.

Subsequently, the toner will be described.

It is preferable that the toner includes at least two metal salts having different valence and has a relationship given by the Formula (1).

$$2.0 \geqq a \geqq 0.1$$

$$1.0 \geqq b \geqq 0.01$$

$$7.5 \geqq a/b \geqq 1.1 \qquad \text{Formula (1)}$$

wherein a (mass %) is defined as a content of a metal salt which is contained at the highest content in the total toner mass, and b (mass %) is defined as a content of a metal salt which is contained at the second-highest content in the total toner mass, and mass values of a and b represent anhydride reduced values.

The valence of the metal salt used in the present invention means a valence of a metallic element constituting thereof.

An example of the measuring method of valence of the metal salt according to the present invention can be, for example, presented, in which fluorescent X-ray intensity emitted from the metal species of the metal salt (for example, calcium due from calcium chloride) is measured by using fluorescent X-ray spectrographic analysis apparatus "system 3270 type" (commercially available from Riken Kogyo Co., Ltd.) to obtain the valence of the metal salt. More specific measuring method is that: a plurality of toners having known contents of the metal salt are prepared and each 5 g of the toners is pelletized, and the relationship (calibration curve) of the contents of the metal salt (a and b) and the fluorescent X-ray intensity from the metal species contained in the metal salt (peak intensity) is measured. Subsequently, the toner (sample), which is to be measured for obtaining the contents of the metal salt therein, is similarly pelletized, and the content, or namely "quantity of metal salt in toner" can be obtained by measuring the fluorescent X-ray intensity from the metal species of metal salt of flocculant.

EXAMPLES OF METAL SALT

The method for adding the metal salt is not particularly limited.

Preferably, in the step of salting-out, cohering and fusing the resin particle from the dispersed fluid of the resin particle prepared in the water solution system, a step of employing a divalent-quadrivalent metal salts as a salting-out agent, or salting out terminator of having lower valence than the salting out agent can be employed. The means of controlling the concentration of the toner may preferably be conducted by confining the metal salt within the toner particle corresponding to the added quantity of the metal salt, the pH-value in the adding process, temperature during/after/the adding process, and thereafter removing salts from the surface by the amount of rinse water.

Further, the temperature for manufacturing the toner is preferably equal to or less than 100 degree C. Having such temperature, the metal cross-linking created by the metal salts of higher valence can be selectively conducted, and thus the metal cross-link structure can be weakened at fixing temperature range of equal to or higher than 120 degree C., by metal ions of lower valence.

In the toner according to the present invention, in order to effectively conduct the metal cross-linking process, the metal salt is preferably an inorganic metal salt, and the specific examples of metal salts are shown as follows.

The divalent metal salt may include magnesium chloride, calcium chloride, chloride of zinc, copper sulfate, magnesium sulfate, manganese sulfate or the like, and the trivalent metal salt may include aluminum chloride, ferric chloride or the like. The quadrivalent metal salt may include titanyl sulfate, tin chloride or the like.

These are appropriately selected according to the objects, and divalent or trivalent metal salt is preferable, since this provides the aggregation thereof proceeding at an appropriate speed thereby providing the control of the particle size more easily. The divalent metal salt is particularly preferable to be employed. The monovalent metal salt may include sodium chloride, potassium chloride, lithium chloride or the like. Besides the metal salt, ammonium salts such as ammonium chloride or the like can be employed. Further, compounds similar to the below-described aggregation initiator can be used as divalent or trivalent metal salt.

The configurations of the preferable metal according to the present invention are shown in Table 1.

TABLE 1

| | Higher-Valent Metallic Salts | Lower-Valent Metallic Salts |
|---|---|---|
| Particularly Preferable Constitutions | Divalent Metallic Salts | Monovalent Metallic Salts |
| Preferable Constitutions | Trivalent Metallic Salts | Divalent Metallic Salts |
| Other Configurations | Trivalent Metallic Salts | Monovalent Metallic Salts |
| | Divalent Metallic Salts | Monovalent Ammonium Salts |
| | Quadrivalent Metallic Salts | Trivalent Metallic Salts |
| | Quadrivalent Metallic Salts | Divalent Metallic Salts |
| | Quadrivalent Metallic Salts | Monovalent Metallic Salts |

In the toner manufactured by salting out/fusing the resin particles, it is preferable to include the later-described anionic surfactant for the water system medium that is used for associating (that is, salting out/fusing) the resin particles to grow them up. A nonionic surfactant or a cationic surfactant may be used together with an anionic surfactant, and the particle diameter can be controlled with higher accuracy by including only an anionic surfactant. Anionic surfactant may be introduced with the resin particle dispersion, or may be newly added in the association process.

The toner is manufactured by salting out/fusing resin particles and manufactured by a step of forming particles within a water-type medium and a step of eliminating odor, and the details of the odor elimination technology according to the present invention will be described as follows.

The odor eliminating processing by using a deodorizer is conducted in any steps from the step of forming the particles within the water-type medium to the step of separating the toner particles containing the resin and the coloring agent from the water-type medium.

Although the examples of the deodorizers available for the present invention is described as follows, it is not intended to limit the scope of the present invention to these deodorizers.

(Plant Extracted Component)

The plant-extracted component available for the present invention is referred to as a composition, in which an extract or an extracted component derived from plants, or a composition which has a structure equivalent to that of the plant-extracted component, is dispersed in the solvent such as water or the like. In the present invention, the odor eliminating material for the plant extracted component may preferably be a compound that is capable of deodorizing the sulfur-type malodor component is preferable, and, for example, plant extract such as green tea extract, persimmon condensed tannin or bamboo extract are preferable, and these compounds have an odor eliminating effects, in which these compounds can chemically decompose hydrogen sulfide or methyl mercaptan into odorless molecules, or surrounds (wraps up) these malodor molecules to provide odorless products.

When the deodorizer of the present invention containing the plant extracted components is manufactured from the green tea, crushed green leaf products of the tea leafs are immersed into ethanol, and then the ethanol extraction solution containing catechin group, vitamin group, saccharide group and enzyme group are filtered and concentrated to obtain a deodorizer containing a plant extracted component according to the present invention. More specifically, the solution is manufactured by extracting the green leafs of the tea leafs with ethanol at a temperature of equal to or less than 80 degree C., for example with ethanol of 50 to 70 degree C., and this solution contains ethanol-soluble components and water-soluble components contained in the green leafs of the tea leafs. In the extraction process of the green leafs of the tea leafs with ethanol the ethanol extracts contains the extracted component that is generally similar to the green tea extract, including flavanol group such as (−)-epicatechin (EC), (−)-epigallo catechin (EgC), (−)-epicatechin gallate (ECg), (−)-epigallo catechin gallate (EGCg) or the like, enzyme group such as oxidation-reduction enzyme, transferase, hydrolase, isomerase or the like, flavonol group such as, for example, flavone, isoflavone, flavonol, flavanone, flavaryl, orlon, anthocyanidin, chalcone, dihydrochalcone or the like, glycosides of flavonol group, caffeine, amino acid group, flavane diol group, polysaccharide group and protein group, vitamin group and so on. Since the green leaf components of the tea leafs changes by weather, atmospheric temperature, crop time and crop place, it is preferable to add the synthesized and purified vitamin C and vitamin B1 to the ethanol extract at a rate of 1 to 2 mass % of the solid contents of the ethanol extract, in order to provide stable and uniform odor elimination persistence time as the deodorizer, and to reinforce the odor elimination effect and odor elimination power of the deodorizer.

Deodorizer is an alcohol solution of such as ethanol, containing catechin group, vitamin group, saccharide group, enzyme group or the like and can further contain the alcohol-extraction residues of the green leafs of the tea leafs. Accordingly, the deodorizer according to the present invention can be produced by immersing the crushed products of the green leafs of tea leafs into ethyl alcohol to extract the components of the tea leafs contained in the green leafs thereof.

The other specific examples of the deodorizer containing plant-extracted component may be from the trees such as Japanese cypress, Aomori cedar, Buna, a cedar, a camphor tree, a eucalyptus or the like, or spicy grass, mustard greens, Japanese horseradish, lemon, Chinese quince, peppermint, *Eugenia aromatica, cinnamomum zeylanicum*, bamboo, Iriomote thistle, or Yaeyamayashi root and the extracts and extracted components can be obtained by processing these plants via crushing, compression, boiling or steam distillation. The specific examples of the extracted components of the plant origin or the synthetic compounds having equivalent chemical structure to the plant extracted components may be: tropolone group such as hinokitiol or the like, monoterpene groups such as α-pinene, β-pinene, camphor, menthol, limonene, borneol, α-terpinene, γ-terpinene, α-terpineol, terpinene-4-ol, cineol or the like, sesquiterpene group such as α-cadinol, t-murol or the like, polyphenol group such as catechin, tannin or the like, naphthalene derivatives such as 2,3,5-trimethyl naphthalene or the like, long-chain aliphatic alcohol such as citronellol or the like, aldehyde group such as cinnamaldehyde, citral, perilla aldehyde or the like, allyl compounds such as allyl isothiocyanate or the like. Further, pyracetic acid slution, which is provided by baking tree in the roaster, can be used for the present invention. When the plant-originated extracted components or the synthetic compounds having chemical structures equivalent to the plant extracted components are not water-soluble, these compounds can be employed by using a dispersant such as surfactants to be dispersed in the water.

As the example of the commercially available plant extracted component deodorizer, for example, F118 (commercially available from Fine 2 Co., Ltd.) or Delsen (commercially available from Yuko Chemical Industries company) are preferably employed.

In the present invention, it is preferable that at least one of the plant extracted component is phytonzid group.

The phytonzid type deodorants contain the plant extract containing a phytonzid as a main component, and manufactured by adding anion activators, glycol group, special activators, host compounds into the natural polymer material having a molecular weight of 15,000 to 2,300,000 extracted from conifer trees, and the advantageous effect thereof is that odorous component is chemically decomposed completely by a neutralization inclusion method to convert thereof into other material. The commercially available phytonzid type deodorants may preferably be "Bio Dash D-200" (commercially available from DAISO).

(Enzyme Type Deodorizer)

In the present invention, before polymerizing the polymerization monomer in the water type solvent, and before separating the toner particles containing at least resins and coloring agents from the water type solvent, it is preferable to treat them with a deodorizer containing enzyme.

In a biological oxidation enzyme, among other things, there are many compounds having the function of oxidative-degrading ammonia, amine, hydrogen sulfide, mercaptan group, indole, carbonyl compounds in a certain types of the metal content enzyme group. That is, since many of odor molecules have volatility hydrogen, the odor elimination process becomes possible by dehydrogenating and oxidizing these molecules, and creating dimer thereof, creating water-soluble compounds and creating non-vaporizing compounds.

The specific examples of enzymes having odor elimination effect may be enzymes such as catalase, amylase, protease, lipase, papain, chymopapain, pepsin or the like. Catalase enzyme includes hematoporphyrin and binds to apoprotein, and contains iron in electronic state of trivalent spin, and also contains histidine glyoxaline nitrogen of protein disposed in the fifth coordination. Further, the commercially available enzyme type deodorizer may preferably be "Bio C" (commercially available from Console Corporation), and "Bio Dash P-500" (commercially available from DAISO Co., Ltd.).

(Metallophthalocyanine Group and Artificial Enzyme Type Deodorizer Employing Thereof)

It is preferable to employ metallophthalocyanine type deodorizers, and to manufacture the toner using the artificial enzyme type deodorizers containing metallophthalocyanine group.

Metallophthalocyanine derivative having catalytic activity similar to that of catalase that is a natural enzyme, preferably carboxy phthalocyanine iron complex, and particularly preferably octacarboxy phthalocyanine iron complex, has an effect of decomposing odor molecules with a reaction kinetics similar to that of catalase. The molecular structure of octacarboxy phthalocyanine iron complex is shown as follows.

[Chemical Formula 1]

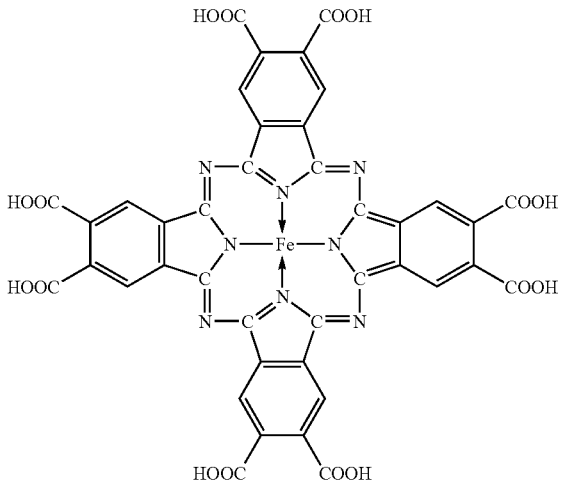

For example, when an example of oxidation mechanism of mercaptan is taken, it is shown with the following chemical reactions:

$$2R—SH+2OH^- \rightarrow 2R—S^-+2H_2O \quad (1)$$

$$2R—S^-+2H_2O+O_2 \rightarrow R—S—S—R+H_2O_2+2OH^- \quad (2)$$

(wherein, R:$CH_3$ or $C_2H_5$):

The thiolate anion, which is generated in the reaction of the upper Formula (1), becomes the active species of the ternary complex, which coordinate in metallophthalocyanine with oxygen, and subsequently as shown in the above-shown Formula (2), the thiolate anion which coordinates in this active species is deodorized by being changed into dimer. In this way, when metallophthalocyanine is employed as the deodorizer, advantageous conditions for decomposing malodor compounds are obtainable, such as:

1: reaction rate is high, and destruction efficiency is better;

2: reaction progresses by an ambient temperature;

3: since it is the water type reaction, there is no worry of the environment pollution;

4: since it is the cyclic reaction, the catalyst duration life is long, and so on.

Further, the artificial enzyme, to which a metallophthalocyanine derivative and a polymer compound are bound via an ionic bonding, may be employed as a deodorizer. The specific example of the polymer compound may be cyclodextrin, which is preferably employed thereto.

(Microorganism Deodorizer)

Before polymerizing the polymerization monomer in the water type solvent, and before separating the toner particles containing at least resins and coloring agents from the water type solvent, it is preferable to treat them with a microorganism type deodorizer.

As for the microorganism type deodorizer according to the present invention, the deodorizer employing the microorganism culture solution is used. As the microorganism, for example, microorganism at least one selected from *Bacillus* species, *Eenterobacter* species, *Streptococcus* species, *Rhizopus* species and *Aspergillus* species can be illustrated. Furthermore, it is preferable to employ microorganism of *Nitrosomonas* species, *Nitrobacter* species and *Pseudomonas* species. The microorganism deodorizer is obtainable by adding a mixture composed of 5 to 100 parts by mass of saccharide, 0.1 to 50 parts by mass of water-soluble nitride and 1,000 to 50,000 parts by mass of water to 10 parts by mass of these microorganisms, and culturing the resultant mixture under the condition of a temperature of 20 to 40 degree C., and an oxygen-feeding at a rate of 0.02 to 2.0 l/min. for 15 to 40 hours, and thereafter drying the supernatant liquid or culture medium obtained via the centrifugal separation. 20 to 300 parts by mass of a porous powder such as sawdust may be added to the culture medium as required, in order to support the microorganism thereon. Further, liquid aldehyde, more specifically glutaraldehyde may be used together with these microorganism type deodorizer. By mixing with the liquid aldehyde, the odor elimination effect considerably increases, and thus is preferable.

The specific examples of the microorganism, which it is preferably employed, may be: in the microorganism of *Bacillus* species, in particular, *Bacillus Subtilis*, [IAM Culture Collection No. 1168 (IAM is an abbreviated designation of Institute of Applied Microbiology, Culture Collection Center of University of Tokyo, and hereinafter referred to as IAM)], or *Bacillus* Natto [IFO No. 3009, (IFO is an abbreviated designation of Institute of Institute for Fermentation Osaka, and hereinafter referred to as IFO)] are preferable, and besides, *Bacillus Coagulans* [IAM No. 1115] and *Bacillus Macerans*) [IAM No. 1243] may also be employed.

As the examples of the microorganism of *Eenterobacter* (*Enterobacter*) species, *Eenterobacter Sakazaki* [IAM No. 12660], *Eenterobacter Agglonerans* [IAM NO. 12659] or the like can be employed.

As the examples of the microorganism of *Streptococcus* species, *Streptococcus Faecalis* [IAM No. 1119], *Streptococcus Cremoris* [IAM NO. 1150], *Streptococcus* Lactis [IFO No. 12546] or the like can be employed.

As the examples of the microorganism (fungus) of *Rhizopus* species, *Rhizopus Formosaensis* [IAM No. 6250], *Rhizopus Oryzae* [IAM No. 6006] or the like can be employed.

As the examples of the microorganism of *Aspergillus* species, *Aspergillus Oryzae* [IFO No. 4176], *Aspergillus Niger* [IFO4066] or the like can be employed.

As the examples of the microorganism of *Nitrosomonas* species, *Nitrosomonas Europaea* [IFO No. 14298] or the like can be employed.

As the examples of the microorganism of *Nitrobacter* species, *Nitrobacter Agilis* [IFO No. 14297] or the like can be employed.

As the examples of the *Pseudomonas* species, *Pseudomonas Caryophilli* [IFO No. 12950], *Pseudomonas Statzeri* [IFO No. 3773] or the like can be employed.

The microorganism deodorizer according to the present invention may includes microorganisms in dormancy, the organic acids which are effective for the odor elimination, and enzyme for decomposing the organic substances. That is, the effects are achieved, in which the microorganisms can convert saccharide and ethyl alcohol into organic acid such as lactic acid, citric acid, malic acid or the like, or the enzyme (amylase, protease, lipase) is produced to decompose the malodor sources (organic substances).

(Plant Oil Deodorizer: 1)

The materials, which are effective for the present invention, are plant essential oils provided from the plants of Lauraceae, Apiaceae, Myrtaceous, Labiate, Pinaceae, Cupressaceae and Gramineae.

More specifically, the following plant essential oil can be illustrated. For example, the expression of "cinnamon oil" appeared in the following descriptions indicates that the "cinnamon oil" is an essential oil extracted from cinnamon with a steam distillation technique. Further, main constitution chemical compound nomenclature in the essential oil components are indicated in the parentheses. These plant essential oils may be used alone or mixed thereof. Further, it is self-evident using a main constitution chemical compound itself.

As Lauraceae, for example, cinnamon oil (cinnamaldehyde, cinnamaldehyde), camphor oil (linalool), ravensara oil (1,8-cineol, α-terpineol), ravensara eugenol oil (1,8-cineol, eugenol), rosewood oil (linalool, α-terpineol), laurier oil (linalool, 1,8-cineol, eugenol) or the like; as Apiaceae, for example, caraway oil (d-carvone, limonene), anise oil (anethole, anisaldehyde), anjelica oil (α-pinene, α-phellandrene), galbanum oil (pinene, γ-cadinol), carrot seed oil (carotol), cumin oil (cuminal), coriander oil (linalool, decanal, decenal, octanal), dill oil (epoxy menthane, phellandrene, carvone), fennel oil (anethole, fenchone), lovage oil (butylidene phthalide, β-phellandrene, terpinyl acetate, ocimene) or the like; as Myrtaceous, for example, eugenia aromatica oil (eugenol acetate, eugenol), cajeput tree oil (1,8-cineol, α-terpineol), tee tree oil (terpinenol-4, γ-terpinene), niaouli oil (1,8-cineol, viridiflorol), niaouli nerolidol oil (nerolidol), myrtle (myrtle or myrtus communis) oil (1,8-cineol, α-pinene, geranyl acetate), eucalyptus globulus oil (globulol, pinocarvone, 1,8-cineol), eucalyptus staigeriana (eucalyptus lemon) oil (citral, geranyl acetate), eucalyptus smithii (α-terpineol, 1,8-cineol), eucalyptus dives oil (piperitone, phellandrene), eucalyptus radiata oil (α-terpineol, 1,8-cineol), eucalyptus citriodora oil (citronellal, citronellol) or the like; as Labiate, for example, sage oil (thujone, camphor), patchouli oil (patchouli alcohol, guaiene), lavender (high-R lavender) oil (linalyl acetate, linalool), rosemary camphor oil (camphor, 1,8-cineol), rosemary cineol oil (1,8-cineol), spearmint oil (l-carvone, limonene), thyme geraniol oil (geraniol, geranyl acetate), thyme thymol oil (thymol, p-cymene), thyme thujanol oil (thujanol-4, terpinenol-4), thyme linalool oil (linalool, linalyl acetate), thyme satureioides oil (borneol, α-terpineol, carvacrol), ocimum basilicum oil (methyl chavicol) or the like;

as Pinaceae, for example, cedarwood oil (cadinene, atlantone), pine oil (α-pinene, β-pinene, β-caryophyllene, α-terpineol), *pinus sylvestris* oil (α-pinene, β-pinene), abies sibirica oil (bornyl acetate, camphene), abies balsamea oil (β-pinene, bornyl acetate) or the like; as Cupressaceae, for example, cupressus sempervirens oil α-pinene, β-pinene, terpinyl acetate, cedrol), Juniper branch oil (α-pinene, β-pinene, thujopsene, sabinene), juniper berry oil (α-pinene, terpinenol-4, germacrone) or the like; and further, as *Gramineae*, for example, citronella oil (methyl isoeugenol, geraniol), palmarosa oil (geraniol, geranyl acetate), vetiver oil (vetiverone), lemongrass oil (geranial, neral, geraniol) or the like, can be illustrated.

(Plant Oil Deodorizer: 2)

The materials, which are effective for the present invention, is characterized in that the materials contains at least one selected from the group consisting of eugenol, cinnamaldehyde, p-cymene, benzaldehyde, benzyl acetate and benzyl benzoate.

Eugenol includes, for example, *ravensara eugenol* (Lauraceae), *ocimum basilicum eugenol* (Labiate), and *eugenia aromatica* (Myrtaceous); cinnamaldehyde includes cinnamon (Lauraceae); p-cymene includes thyme thymol (Labiate); and benzyl benzoate includes ylang ylang (van Litchi chinensis).

In addition to above, the plant oil manufacture means aromatic and volatility oils, which are obtainable from flowers, leafs, fruits, branches, roots or the like of various kinds of plants.

(Amyris Oil Type Deodorizer)

Amyris oil is a plant essential oil extracted from xylems and seeds of (*Amyris Balsamifera*, which is a Rutaceae vegetated in the northern part of the North America, with a steam distillation. The main constituents are cadinol, cadinene and caryophyllene.

Method of the application is to use a surfactant to emulsify the amyris oil in the water. This emulsion is used as a cleaning solution in the filtration and washing process after conducting the reaction of polymerization or salting out/fusing. As a result, this reacts with a chain transfer agent remaining on the surface of the coloring particle, and thus decomposing the odorous component and eliminating the odor by the chemical reaction.

(Macrocyclic Lactone and Macrocyclic Ketone Compounds)

The macrocyclic lactone compounds used as flavor may be, for example, 14-tetradecanolide, 15-pentadecanolide, 11(or12)-pentadecene-15-olide, 16-hexadecanolide and 9-hexadecene -16-olide.

Further, as macrocyclic ketone compounds used as flavor, for example, cyclopentadecanone, 3-methyl-cyclopentadecanone, cyclohexadecanone, 5-cyclohexadecene-1-one, 8-cyclohexadecene-1-one, cycloheptadecanone, 3-ethyl-cyclopentadecanone, 3-propyl-cyclopentadecanone, 9-cycloheptadecene-1-one, cycloheneicosanone, 3-methyl-cycloheneicosanone, and 11-cycloheneicosen-1-one can be illustrated.

(Pyruvic Ester Group)

It is found that highly effective odor elimination effects with higher safety can be obtained by employing a pyruvic ester group shown below.

[Chemical Formula 2]

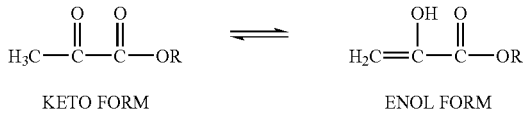

Here, R represents linear, branched or cyclic alkyl group, alkenyl group, aryl group and aralkyl group having 1 to 18 carbons. More specifically, alkyl group may includes groups such as methyl group, ethyl group, propyl group, isopropyl group, butyl group, isobutyl group, amyl group, isoamyl group, hexyl group, heptyl group, octyl group, nonyl group, 2-ethylhexyl group, decyl group, cyclopentyl group, cyclohexyl group or the like; and aryl group may includes phenyl group, or substituted phenyl group such as tolyl group, p-chlorophenyl group or the like. Further, aralkyl group may include benzyl group, phenethyl group, phenylpropyl group, methylbenzyl group, dimethylbenzyl group, trimethyl benzyl group, P-isopropyl benzyl group. Aralkyl group may include norbornyl group, citronellyl group, geranyl group or the like.

On application of these chemical compounds, these compounds can be empolyed alone or mixed thereto. Preparation of pyruvic acid can be carried out by conducting an esterification of pyruvic acid via a commonly known method, or by conducting a method for oxidizing lactic acid ester or the like.

In the method of the application, a surfactant is first used to emulsify the pyruvic esters in the water. Subsequently, it is preferable to clean thereof by adding pyruvic esters to a cleaning solution for the toner particles so that the ratio of pyruvic esters is 0.001 to 1 mass % level over the whole coloring particles at the time of the cleaning process. Concerning this cleaning step, since the effect of the cleaning increases by repeating the step, the cleaning step may be repeated.

(Deodorizer Dissolved or Dispersed in Water)

Before polymerizing the polymerization monomer in the water type solvent, and before separating the toner particles containing at least resins and coloring agents from the water type solvent, it is preferable to treat them with a deodorizer dissolved or dispersed in the water, and more specifically, among the toner manufacturing process comprising the polymerization step, the salting out/fusing step, the solid-liquid separation step, the drying step and the externally adding step, it is particularly preferable to process an odor elimination in any step from the polymerization step to the solid-liquid separation step.

The deodorizer solution may contain the water in a ratio of equal to or higher than 50 mass %, and may further contain alcohols, alcoholamines, surfactants and organic acids such as citric acid or the like.

(Adsorption of Deodorizer to Toner Particle Surface)

Even if the toner odorous components ooze from toner interior, in the drying step or after the step of sealing the package, it is preferable that deodorizer takes the condition, which adsorbed on the surface, in view of maintaining the odor elimination function. Although the method for adsorbing thereof may not be particularly limited, it is desirable to dissolve or disperse the water type medium for polymerize, salt out and flocculate the toner, after removing the residual deposits of surfactant and salting out agent in the toner filtration cleaning process discussed later, it is particularly preferable to treat with the deodorizer liquid of high concentration. It is preferable that the concentration of the deodorizer for adsorbing may be 0.01 to 10 ppm over the toner. The concentration of equal to or less than 0.01 ppm provides lower durability for the odor elimination function, and the concentration of equal to or higher than 10 ppm provides unstable charging characteristics.

Further, the polymerization method toner comprising the resin and the colorant which are formed by polymerizing the radical polymerization monomer containing the above-mentioned respective chain transfer agents in the water type medium, it is preferable that radical polymerization monomer is contained in the polymerization method toner in the concentration of equal to or less than 200 ppm and the chain transfer agent is contained in the concentration of equal to or less than 50 ppm. In order to achieve this, in the method for manufacturing the polymerization method toner by fusing the resin particle which is formed by polymerizing the radical polymerization monomer including the chain transfer agent in the water type medium with at least using the water soluble polymerization initiator in the water type medium, it is preferable to conduct the manufacturing method by adding the water-soluble polymerization initiator for a plurality of cycles.

Further, in the polymerization method toner, it is preferable to use the chain transfer agent itself emitting lower odor, and the chain transfer agent available in the present invention will be listed below, though it is not intended to limit the scope of the present invention thereto.

An example of the chain transfer agent may be chemical compound shown in the following general formula (1) or general formula (2).

$$HS—R_1—COOR_2 \qquad \text{General formula (1)}$$

(wherein, in the general formula, $R_1$ is hydrocarbon group having 1 to 10 carbons and may have substituent group, $R_2$ is hydrocarbon group having 2 to 20 carbons and may have substituent group,)

The preferable chemical compounds of the above-mentioned general formula (1) may be thioglycollic acid ester or 3-mercaptopropionic acid ester. More specifically, thioglycollic acid ester includes ethyl thioglycolate, butyl thioglycolate, t-butyl thioglycolate, 2-ethylhexyl thioglycolate, octyl thioglycolate, isooctyl thioglycolate, decyl thioglycolate, dodecyl thioglycolate, thioglycollic acid ester of ethylene glycol, thioglycollic acid ester of neopentyl glycol, thioglycollic acid ester of trimethylolpropane, thioglycollic acid ester of pentaerythritol and thioglycollic acid ester of sorbitol; and 3-mercaptopropionate ester includes ethyl ester, octyl ester, decyl ester, dodecyl ester, pentaerythritol tetrakis ester, 3-mercaptopropionate ester of ethylene glycol, 3-mercaptopropionate ester of neopentyl glycol, 3-mercaptopropionate ester of trimethylolpropane, 3-mercaptopropionate ester of pentaerythritol and 3-mercaptopropionate ester of sorbitol.

$$HS—R_3 \qquad \text{General formula (2)}$$

(wherein, in the general formula, $R_3$ is hydrocarbon group having 1 to 20 carbons and may have substituent group.)

The preferable compounds may include n-octyl mercaptan, 2-ethylhexyl mercaptan, n-dodecyl mercaptan, sec-dodecyl mercaptan and t-dodecyl mercaptan.

Further, other preferable chain transfer agent may be terpen type compound. Terpen type compounds includes the compound having performances same as mercaptan type compound for the chain transfer agent, and having the performance that does not emit any odor in the fixing process by heating. That is, in the toner, in terpen type compound, it is preferable to employ the toner which utilizes the resin fine particles produced via the polymerization method using monoterpene or sesquiterpene type compounds as the chain transfer agent. Furthermore, the particularly preferable chemical compound in monoterpene type compounds may include α-pinene, β-pinene, 3-carene, camphene, limonene, terpinolene, α-terpinene, myrcene, α-terpineol, β-terpineol, linalool, nerol, and Geraniol, and particularly preferable compounds in sesquiterpene type chemical compounds may include longifolene and caryophyllene.

The monoterpene type compound chain transfer agents and sesquiterpene type compound chain transfer agents may be employed in a manner same as that employed for chain transfer agents such as conventionally known thioglycerine, thioglycollic acid, thioglycollic acid ester, mercaptan type compound, tetrachloromethane, chloroform or the like.

The amount of monoterpene type compound or sesquiterpene type compound may preferably be 0.01 to 5 mass % for the amount of the radical polymerization monomer composition and more preferably 0.05 to 4 mass The rate of equal to or less than 0.01 mass % provides insufficient effect thereof, and the rate exceeding 5 mass % provides remaining the chain transfer agent with the condition of not reacting and is not preferable.

Further, as other preferable chain transfer agent, mercapto silane type chain transfer agent can be used.

As mercapto silane type chain transfer agents available for the present invention may includes, for example, mercaptomethyl dimethoxy silane, mercaptomethyl diethoxy silane, mercaptomethyl ethyl dimethoxy silane, mercaptomethyl ethyl diethoxy silane, 2-mercaptoethyl dimethoxy silane, 2-mercaptoethyl diethoxy silane, 2-mercaptoethyl ethyl dimethoxy silane, 2-mercaptoethyl ethyl diethoxy silane, 3-mercapto propyl methyl dimethoxy silane, 3-mercapto propyl methyl diethoxy silane, 3-mercapto propyl ethyl dimethoxy silane, 3-mercapto propyl ethyl diethoxy silane, 4-mercapto butyl methyl dimethoxy silane, 4-mercapto butyl methyl diethoxy silane, 4-mercapto butyl ethyl dimethoxy silane, 4-mercapto butyl ethyl diethoxy silane, 8-mercapto octyl ethyl dimethoxy silane, 8-mercapto octyl ethyl diethoxy silane, 12-mercapto dodecyl ethyl dimethoxy silane, 12-mercapto dodecyl ethyl diethoxy silane or the like. The preferable amount of use of the above chemical compounds may be 0.01 to 5 mass % over the whole toner mass.

Further, known water-soluble chain transfer agents can be employed for the other chain transfer agents, and the examples thereof may include, for example, sodium sulfite, sodium bisulphite, bisulfite potassium, sodium pyrosulfite, potassium pyrosulfite, chloromethanol, 2-chloroethanol, 1-chloro-2-propanol, 2-chloro-n-propanol, 3-chloro-n-propanol, 2-chloro-n-butanol, 3-chloro-n-butanol, 4-chloro-n-butanol, chloropentanol, chlorohexanol, chloroheptanol, chlorooctanol, monochloroacetate, dichloroacetic acid, trichloroacetic acid, chloro difluoro acetic acid, α-chloropropionate, β-chloropropionate, p-chlorobenzoic acid, 2-chloro-6-fluorobenzoate, α-bromopropionic acid, β-bromopropionic acid, 2-bromo-n-valeric acid, 5-bromovaleric acid, 11-undecanoic acid, α-bromophenylacetic acid, p-bromophenylacetic acid, 2-bromooctane acid, 2-bromopentane acid, 2-bromohexanoic acid, 6-bromohexanoic acid, chlorosuccinic acid, chlorofumaric acid, chloromaleic acid, chloromalonic acid or the like.

Next, the method for manufacturing toner will be described.

(Method for Manufacturing Toner)

One of the characteristics of the method for manufacturing the toner according to the present invention is that the polymerization process for the polymerization monomer is carried out within the water type medium. That is the method, in which, when the resin particle (nuclear particle) containing mold releasing agent or coating layer (interlayer) is formed, the mold releasing agent is dissolved in the monomer, and the obtained monomer solution is drop-dispersed in the water type medium, and further the polymerization initiator is added in this medium to conduct the polymerization process, thereby obtaining the products as latex particles.

The water type medium as set forth in the present invention means the medium containing 50 to 100 mass % of water and 0 to 50 mass % of the water-soluble organic solvent. As water-soluble organic solvent, for example, methanol, ethanol, isopropanol, butanol, acetone, methyl ethyl ketone, tetrahydrofuran or the like can be exemplified, and it is preferable to employ the alcohol type organic solvent which does not dissolve the obtained resin.

One example of the method for manufacturing the toner will be described as follows.

The manufacturing process of the toner is mainly constituted of the processing steps shown below.

1: A multistage polymerization step (I) for obtaining the composite resin particles, in which mold releasing agent and/or crystalline polyester is contained in the region (core or midlayer) except the external layer thereof;

2: A salting out/fusing step (II) for salting out/fusing the composite resin particles and the colorant particles to obtain the toner particles;

3: A filtering/cleaning step for filtering the toner particles from the distributing liquid system for the toner particles to remove the surfactant from the toner particle;

4: A drying step for drying the toner particles which has been cleaned; and

5: A step for adding the external addition agent to the toner particles, which has been dried.

Each of the step will be described in detail as follows.

[Multistage Polymerization Step (I)]

A multistage polymerization step (I) is the step, in which the composite resin particles are manufactured by forming the coating layer that comprises polymer of the monomer on surface of resin particles formed by the multistage polymerization method.

It is preferable to adopt the multistage polymerization method of equal to or more than three-step polymerization, in view of maintaining the stability of the manufacturing process and improving the breaking strength of the obtained toner.

The two-step polymerization method and three-step polymerization method, which are a representative example of the multistage polymerization method, will be described as follows.

(Two-Step Polymerization Method)

The two-step polymerization method is a method for manufacturing the composite resin particles composed of the core (nucleus) formed of the high molecular weight resin containing the mold releasing agent and an outer layer (shell) formed of low molecular weight resin. That is, the composite resin particles obtained via two-step polymerization method consists of nucleus and one level of the coating layer.

Describing the method more specifically, first of all, the mold releasing agent is dissolved in monomer L to prepare the monomer solution, and after drop-dispersing this monomer solution in the water type medium (for example, aqueous solution of a surfactant), the polymerization processing (the first step polymerization) of this system is carried out to prepare the dispersion liquid of the resin particles of high molecular weight including the mold releasing agent.

Subsequently, the polymerization initiator and monomer L for obtaining the low molecular weight resin are added to the dispersion liquid of the resin particles, and the polymerization processes for monomer L under the presence of the resin particles is carried out (the second step polymerization) to form the coating layer, which consists of resin of low molecular weight (polymer of monomer L), on the surface of the resin particles, and thus the method is completed.

(Three-Step Polymerization Method)

The three-step polymerization method is a method for manufacturing the composite resin particles composed of the core (nucleus) formed of high molecular weight resin, the interlayer containing the mold releasing agent and the outer layer (shell) formed of low molecular weight resin. That is, the composite resin particles obtained via the three-step polymerization method are composed of the nucleus and coating layers of the dual layers.

Describing the method more specifically, first of all, the dispersion liquid of the resin particles obtained by the polymerization processing which is carried out according to the usual method (the first plate polymerization) is added into the water type medium (for example, aqueous solution of a surfactant), and after drop-dispersing the monomer solution, which contains the mold releasing agent dissolved in monomer M, into above-described water type medium, the polymerization processing (the second step polymerization) of this system is carried out to form the coating layer (interlayer) consisting of the resin (polymer of monomer M) containing the mold releasing agent on the surface of resin particles (nuclear particle), thereby preparing the dispersion liquid of the composite resin particle (high molecular weight resin—medium molecular weight resin).

Subsequently, polymerization initiator and monomer L for obtaining low molecular weight resin are added into the dispersion liquid of the obtained composite resin particles, and the polymerization processes for monomer L under the presence of the composite resin particles is carried out (the third step polymerization) to form the coating layer, which consists of resin of low molecular weight (polymer of monomer L), on the surface of the composite resin particles. In the above method, the mold releasing agent can be finely and uniformly dispersed by incorporating the second plate polymerization step in the manufacturing process, and thus is preferable.

The polymerization method, which is preferable for forming the resin particles or the coating layer containing the mold releasing agent, may include the method for conducting the radical polymerization in the oil drops by dispersing the monomer solution, which includes monomer with mold releasing agent dissolved therein in the water type medium, in which a surfactant having a concentration equal to or less than the critical micelle concentration by utilizing a mechanical energy to prepare the dispersion liquid, and adding the water soluble polymerization initiator into the obtained dispersion liquid (hereinafter called "mini-emulsion technique" in the present invention), and the method can fully provide the advantageous effect of the present invention, and thus is preferable. Here, in the above method, oil soluble polymerization initiator may be replaced with water-soluble polymerization initiator, or employed with the water-soluble polymerization initiator.

According to the mini-emulsion technique automatically forming oil drops, unlike the usual emulsion polymerization method, enough amount of the mold releasing agent can be introduced in the formed resin particles or in the coating layer without eliminating the mold releasing agent, which is dissolved in the oil phase.

Here, the disperser for conducting the oil drop dispersion by the mechanical energy is not particularly limited, and may includes, for example, stirring apparatus "CLEARMIX", that comprises a rotor capable of rotating at higher speed (commercially available from M-Technique Co., Ltd.), an ultrasonic dispersion machine, a machine homogenizer, a Manton Gaulin homogenizer, a compression homogenizers or the like. Further, the dispersed particle diameter may be 10 to 1,000 nm, and preferably 50 to 1,000 nm and more preferably 30 to 300 nm.

In addition to above, as the other polymerization method for forming the resin particles containing the mold releasing agent or forming the coating layer, known methods such as emulsion polymerization method, suspension polymerization method, seed polymerization method or the like can be adopted. Further, these polymerization methods may also be adopted to obtain the resin particles (nuclear particle) constituting the composite resin particles or the coating layer, which are free of the mold releasing agent and the crystalline polyester.

The particle diameter of the composite resin particles obtained from the polymerization step (I) may preferably be in a range of 10 to 1,000 nm as the mass mean particle diameter measured using the electrophoretic light scattering photometer "ELS-800" (commercially available from Otsuka Electronic Co., Ltd.).

Further, it is preferable that the glass transition temperature (Tg) of the composite resin particles is in the range of 48 to 74 degree C., and it is more preferably 52 to 64 degree C.

Further, it is preferable that the softening point of the composite resin particle is in the range of 95 to 140 degree C.

[Salting Out/Fusing Step (II)]

The salting out/fusing step (II) is a step for obtaining the toner particle of indefinite form (non-spherical form) by salting out/fusing the composite resin particles obtained via the aforementioned multistage polymerization step (I) and the colorant particles (proceeding the salting out process and the fusing process simultaneously).

The term "salting out" used in the present invention means flocculating the composite resin particles, which are in the condition of being dispersed in the aqueous medium by utilizing the function of salt. Further, the term "fusing" means disappearing the interface between particles of the resin particles, which are flocculated by the above salting-out. The term "salting out/fusing" used in the present invention means two steps of salting out and fusing are taken place in sequence, or causing these steps in sequence. In order to causing the salting out step and the fusing simultaneously, it is necessary to flocculate the particle (composite resin particles, colorant particles) at the temperature condition of equal to or higher than the glass transition temperature (Tg) of the resin constituting the composite resin particles.

In this salting out/fusing step (II), the internal addition agent particles such as charging control agent or the like (fine particles having a number average primary particle diameter of about 10 to 1000 nm level) may be salting out/fused together with the composite resin particles and the colorant particles. Further, the colorant particles may be surface-reformed, and a known conventional surface reforming agent may be employed.

Salting out/fusing processing of the colorant particles is carried out with a condition of being dispersed in the aqueous medium. As the aqueous medium containing the dispersed colorant particles, aqueous solution, in which a surfactant is dissolved with a concentration of equal to or higher than the critical micelle concentration (CMC), is preferable.

The disperser using for dispersing processing of the colorant particles is not particularly limited, and may preferably includes a stirring apparatus "CLEARMIX", that comprises a rotor capable of rotating at higher speed (commercially available from M-Technique Co., Ltd.), an ultrasonic dispersion machine, a machine homogenizer, a Manton Gaulin homogenizers, a pressurizing disperser such as a compression homogenizer, a Getzmann mill, a medium type disperser such as a diamond fine mill or the like.

In order to salting out/fusing the composite resin particles and the colorant particles, it is necessary to add the salting out agent (flocculent) having a concentration of equal to or higher than the critical aggregation concentration into the dispersion liquid, in which the composite resin particles and the colorant particles are dispersed, while heating this dispersion liquid to a temperature equal to or higher than the glass transition temperature (Tg) of the composite resin particles.

The preferable temperature range for salting out/fusing may be within a range of from (Tg+10 degree C.) to (Tg+50 degree C.), and more preferably within a range of from (Tg+15 degree C.) to (Tg+40 degree C.). Further, in order to conduct the fusing process effectively, an organic solvent capable of infinitely dissolving in water may be added.

[Filtration and Cleaning Processes]

In this filtration/cleaning processes, the filtration process for filtering the toner particles from the dispersion system of the toner particles obtained in the step mentioned above, and the cleaning process for removing the residual deposits of surfactant and/or salting out agent from the filtered toner particles (cake-like flocculates) are conducted.

Here, the filtration processing methods may include the centrifugal separation method, the filtration under diminished pressure method utilizing a nutsche filter, a filtration method utilizing a filter press or the like, and not particularly limited thereto.

[Drying Step]

This drying step is a process step, in which the drying processing is carried out for the toner particles that have been clean-processed.

The drying machine used in this step may include a spray dryer, a vacuum freeze dryer, a reduced pressure drying machine or the like, and preferable drying machine for the use in the present invention may be a standing type shelf drying machine, a portable type shelf drying machine, a fluidized bed drying machine, a rotary drying machine, a stirrer type drying machine or the like.

The moisture of the toner particles, which have been dry processed, may preferably be equal to or less than 5 mass %, and more preferably equal to or less than 2 mass %.

In addition to above, when the dry processed toner particles are flocculated with weak attractive forces therebetween, the flocculates may be crushing-processed. In this place, the crushing processing unit may include mechanical crushing machines such as a jet mill, a henschel mixer, a coffee mill, a food processor or the like.

The toner according to the present invention may preferably be prepared by forming the composite resin particles under the condition of free of any colorant, adding the dispersion liquid of the colorant particles into the dispersion liquid of the composite resin particles, and salting out/fusing the composite resin particles and the colorant particles.

As such, the polymerization reaction for obtaining the composite resin particles is not obstructed by conducting the preparation of the composite resin particles in the system, in which any colorant does not exist. Thus, according to the toner of the present invention, contamination of the fixing apparatus by the accumulation of the toner and the image stain are not generated without deteriorating the superior offset resistance.

Further, as a result that the polymerization reaction for obtaining the composite resin particles is ensured to be conducted, monomer and oligomer do not remain in the obtained toner particles, and bad odor is not generated in the thermal fixing step in the process for forming the image utilizing this toner.

Further, the surface characteristics of the obtained toner particle are homogeneous, and the distribution of the quantity of charging also becomes sharp, thus the image, which is superior in the sharpness, can be formed for longer term. By employing the toner, in which the composition, the molecular weight and the surface characteristics are uniform between the toner particles, improvements in the offset resistance and in the characteristics for preventing the winding up can be achieved, while maintaining better adhesive property (high fixing strength) for the image support in the image formation process including the fixing step by the contact heating manner, and thus the image having moderate glossiness can be obtained.

Next, respective configuration factor used in the toner manufacturing process will be described in detail.

(Polymerization Monomer)

Polymerization monomer for producing the resin (binder) used for the present invention contains hydrophobic monomer as an essential configuration component thereof, and cross-linking monomer is additionally employed as required. Further, as described below, it is desirable to contain at least one of monomer having acid polar group or monomer having basic polar group.

(1) Hydrophobic Monomer

Hydrophobic monomer constituting monomer component is not particularly limited, and conventionally known monomer can be employed. Further, one, two or more monomers may be combined to be used so that the required properties are satisfied.

More specifically, mono vinyl aromatic type monomers, (meta) acrylate type monomers, vinylester type monomers, vinyl ether type monomers, monoolefin type monomers, diolefin type monomers, halogenation olefinic type monomers can be employed.

Vinyl aromatic type monomer, for example, may include styrene type monomers and derivatives such as styrene, o-methylstyrene, m-methylstyrene, p-methylstyrene, p-methoxystyrene, p-phenyl styrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, 3,4-dichloro styrene or the like.

Acrylic type monomer may include acrylic acid, methacrylic acid, methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, β-hydroxy ethylacrylate, γ-amino propylacrylate, stearyl methacrylate, dimethylaminoethyl methacrylate, diethylaminoethyl methacrylate or the like.

Vinylester type monomer may include vinyl acetate, vinyl propionate, vinyl benzoate or the like.

Vinyl ether type monomer may include vinyl methyl ether, vinyl ethyl ether, Vinyl isobutyl ether, vinyl phenyl ether or the like.

Monoolefin type monomer may include ethylene, propylene, isobutylene, 1-butene, 1-pentene, 4-methyl-1-pentene or the like.

Diolefin type monomer may include butadiene, isoprene, chloroprene or the like.

(2) Cross-Linking Monomer

Cross-linking monomer may be added in order to improve the characteristics of the cross-linking monomer resin particles. Cross-linking monomer may include monomer having two or more unsaturated bonds, such as for example, divinylbenzene, divinyl naphthalene, divinyl ether, diethyleneglycol methacrylate, ethylene glycol dimethacrylate, polyethyleneglycol dimethacrylate, diallyl phthalate or the like.

(3) Monomer Having Acidity Polar Group

Monomer having acidity polar group having acid polar group may include: (a) α,β-ethyleny unsaturated compound having carboxyl group (—COOH) and (b) α,β-ethyleny unsaturated compound having sulfone group (—$SO_3H$).

Examples of α,β-ethyleny unsaturated compound having —COO group of the above (a) may be acrylic acid, methacrylic acid, fumaric acid, maleic acid, itaconic acid, cinnamic acid, maleic acid monobutyl ester, maleic acid mono octyl ester, salts of these compounds with metal such as Na, Zn or the like.

Examples of α,β-ethyleny unsaturated compound having —$SO_3H$ group of the above (b) may be styrene sulfonate and Na salt thereof, allylsulfosuccinic acid, octylallyl sulfosuccinate and Na salt thereof, or the like.

(4) Monomer Having Basic Polar Group

Monomer having basic polar group having basic polar group may be (i) (meta) acrylic acid ester of aliphatic alcohol having amine group or quaternary ammonium group and having 1 to 12 carbons, preferably 2 to 8 carbons and particularly preferably 2 carbons, (ii) (meta) acrylic acid amide or substituted (meta) acrylic acid amide mono-substituted or di-substituted with alkyl group having 1-18 carbons on N, (iii) vinyl compound substituted with heterocyclic group having N as members of ring, and (iv) N, N-diallyl-alkylamine or quaternary ammonium salt thereof. Among these, (1) (meta) acrylic acid ester of aliphatic alcohol having amine group or quaternary ammonium group is preferable as monomer having basic polar group.

Examples of (i) (meta) acrylic acid ester of aliphatic alcohol having amine group or quaternary ammonium group may be dimethylaminoethyl acrylate, dimethylaminoethyl methacrylate, diethylaminoethyl acrylate, diethylaminoethyl methacrylate, quaternary ammonium salts of above-listed four compounds, 3-dimethylaminophenyl acrylate, 2-hydroxy-3-methacryloxy propyl trimethylammonium salt or the like.

(ii) (meta) acrylic acid amide or substituted (meta) acrylic acid amide mono-substituted or di-substituted with alkyl group having 1 to 18 carbons on N may be acrylamide, N-butylacrylamide, N,N-dibutyl acrylamide, piperidyl acrylamide, methacryl amide, N-butyl methacryl amide, N,N-dimethylacrylamide, N-octadecyl acrylamide or the like.

(iii) vinyl compound substituted with heterocyclic group having N as members of ring may include vinylpyridine, vinylpyrrolidone, vinyl-N-methylpyridinium chloride, vinyl-N-ethylpyridinium chloride or the like.

Examples of (iv) N,N-diallyl-alkylamine may be N,N-diallylmethylammonium chloride, N,N-diallyl ethylammonium or the like.

(Polymerization Initiator)

Radical polymerization initiator is appropriately available for the use in the present invention as long as being water soluble. For example, persulfates (for example, potassium persulfate, ammonium persulfate or the like), azo compounds (for example. 4,4'-azobis 4-cyanovaleric acid and salts thereof, 2,2'-azobis(2-amidinopropane) salt or the like), peroxide compounds or the like. Furthermore, above-mentioned radical polymerization initiator can be combined with reducing agent as required to create a redox type initiator. By employing redox type initiator, the polymerization activity increases, the polymerization temperature can be decreased, and furthermore, the polymerization time can be reduced and thus is preferable.

Polymerization temperature may be selected from any temperature, provided that the temperature is equal to or higher than the minimum radical generation temperature of polymerization initiator, and for example, 50 degree to 90 degree may be employed. However, polymerization can be carried out at a room temperature or temperature not less than the room temperature by employing a polymerization initiator for initiating at a room temperature, for example, a combination of hydrogen peroxide—reducing agent (ascorbic acid or the like).

(Surfactant)

In particular in order to carry out mini-emulsion polymerization by using the above-mentioned polymerization monomer, a surfactant is preferably used to carry out the drop oil dispersion in the water type medium. The surfactants available in this case are not particularly limited, and the following ionic surfactant can be illustrated for examples of the preferable compound.

Ionic surfactant may include, for example, sulfonates (sodium dodecylbenzenesulfonate, sodium aylalkylpolyethersulfonate, 3,3-disulphonediphenylurea-4,4-diazo-bis-amino-8-naphthol-6-sodiumsulfonate, ortho-carboxybenzene-azo-dimethylaniline, 2,2,5,5-tetramethyltriphenylmethane-4,4-diazo-bis-β-naphthol-6-sodium sulfonate or the like), sulfuric ester salts (sodium dodecylsulfate, sodium tetradecylsulfate, sodium pentadecylsulfate, sodium octylsulphate or the like), and fatty acid salt (sodium oleate, sodium laurate, sodium caprate, sodium caprylate, sodium caproate, potassium stearate, calcium oleate or the like).

Further, nonionic surfactant can also be employed. More specifically, for example, polyethylene oxide, polypropylene oxide, a combination of polypropylene oxide and polyethylene oxide, ester with polyethylene glycol and higher fatty acid, alkylphenol polyethylene oxide, ester of higher fatty acid and polyethylene glycol, ester of higher fatty acid and polypropylene oxide, sorbitan ester or the like, can be employed.

Although these surfactants are used as emulsifying agents mainly in the emulsifying polymerization process, these may be used for other steps or other purposes.

(Molecular Weight Distribution of Resin Particles and Toner)

The toner according to the present invention may have a molecular weight distribution having a peak or shoulder within a range of 100,000 to 1,000,000, and preferably within a range of 1,000 to 50,000, and more preferably having a peak or shoulder within a range of 100,000 to 1,000,000, 25,000 to 150,000 and 1,000 to 50,000.

Concerning the molecular weight of the resin particles, it is preferable to contain at least both of high molecular weight component having a peak or shoulder of the molecular weight distribution within a range of 100,000 to 1,000,000 and low molecular weight component having a peak or has shoulder of the molecular weight distribution within a range of from 1,000 to less than 50,000. It is more preferable to employ medium molecular weight resin having a peak or shoulder of the peak molecular weight distribution within a range of 15,000 to 100,000.

The method for measuring the molecular weight of the toner or resin may preferably be the GPC (gel permeation chromatography) measurement utilizing a solvent of THF (tetrahydrofuran). That is, 1.0 ml of THF is added to 0.5 to 5 mg of, and more specifically 1 mg of, the test sample, and the mixtures are stirred using a magnetic stirrer at a room temperature to fully dissolve thereof. Then, after processed with a membrane filter having the pore size of 0.45 to 0.50 μm, the resultant product is injected into the GPC. The measurement condition of the GPC may be that the column is stabilized at 40 degree C., THF is introduced at a flow rate of 1.0 ml per minute, and about 100 μl of the sample having a concentration of 1 mg/ml is injected therein to conduct the measurement. It is preferable to use the column combined with the commercially available polystyrene gel column. For example, combination of Shodex GPC KF-801, 802, 803, 804, 805, 806 and 807 commercially available from Showa Denko Co., Ltd. or combination of TSK gel G1000H, G2000H, G3000H, G4000H, G5000H, G6000H, G7000H and TSK guard column commercially available from Tosoh Co., Ltd. or the like can be illustrated. Further, as detector, an UV detector or a refractive index detector (IR detector) may be employed. In the measurement of molecular weight of the sample, the molecular weight distribution that the sample has may be calculated using a calibration curve obtained by using mono-dispersing polystyrene standard particle. It is preferable to use about 10 kinds of the polystyrene particles for obtaining the calibration curve.

(Flocculant)

The flocculant used for the present invention may preferable be selected from metal salts.

The metal salts may include salts of monovalent metal such as, for example, alkali metal such as sodium, potassium, lithium or the like, salts of divalent metal such as, for example, alkaline earth metal such as calcium, magnesium or the like, divalent metal salts of such as manganese, copper or the like, and trivalent metal salts of such as iron, aluminum or the like.

The specific examples of these metal salts will be shown below. Specific examples of the metal salts of monovalent metal may include sodium chloride, potassium chloride, lithium chloride or the like; and specific examples of the metal salts of divalent metal may include calcium chloride, zinc chloride, copper sulfate, magnesium sulfate, manganese sulfate or the like. Specific examples of the metal salts of trivalent metal may include aluminum chloride, iron chloride or the like. These are appropriately selected according to the objects. Generally, the critical aggregation concentration (coagulation value or coagulation point) is smaller for the metal salts of divalent metal than that for the metal salts of monovalent metal, and furthermore, the critical aggregation concentration of metal salts of trivalent metal is smaller.

The critical aggregation concentration used in the present invention is an indicator for the stability of the dispersed matter in aqueous dispersion, and indicates a concentration thereof at a point of commencing the aggregation by adding a flocculant therein. This critical aggregation concentration significantly changes depending on the type of the latex itself and the type of the dispersing agent. For example, this is described by Seizo Okamura et al., KOBUNSHI KAGAKU (Polymer Chemistry), 17,pp. 601 (1960), and the value can be known according to these descriptions. Further, as an alternative method, it is possible to define the critical aggregation concentration as a salt concentration of the point, where ζ potential starts to change, by adding a desired salt into the targeted particle dispersion liquid with different concentration of the salt to measure ζ potential of the dispersion liquid.

In the present invention, polymer fine particle dispersion liquid is processed so that the concentration thereof is equal to or higher than the critical aggregation concentration by using the metal salt. In this occasion, needless to say, it is arbitrarily selected according to the object thereof whether metal salt is directly added or aqueous solution is added. When the adding process is conducted via the aqueous solution, it is necessary for the concentration of the added metal salt to be equal to or higher than the critical aggregation concentration of polymer particle over the volume of the polymer particle dispersion and the total volume of the metal salt aqueous solution.

The concentration of the metal salt as the flocculant in the present invention may be equal to or higher than the critical aggregation concentration, and preferably equal to or higher than 1.2 times of the critical aggregation concentration, and more preferably equal to or higher than 1.5 times.

(Colorant)

The toner according to the present invention is obtained by salting out/fusing the above-described composite resin particles and the colorant particles.

The colorants composing the toner according to the present invention (the colorant particles which are presented for being salted out/fused with the composite resin particles) may be various inorganic pigments, organic pigments, color or the like. Conventionally known inorganic pigments may be employed. Specific inorganic pigments are exemplified as follows.

As the black pigments, for example, carbon black such as furnace black, channel black, acetylene black, thermal black, lamp black or the like, and further, magnetic powder such as magnetite or ferrite may be employed.

One of these inorganic pigments can be selected alone to be employed, or the combination of these inorganic pigments can be simultaneously employed, as desired. Further, the quantity of addition of the pigments may be 2 to 20 mass % over polymer, and preferably 3 to 15 mass % may also be selected.

When it is used as magnetic toner, the above-mentioned magnetite can be added. In this case, in view of providing the predetermined magnetic characteristics thereto, it is preferable to add 20 to 60 mass % thereof into the toner.

Conventionally known organic pigments and colors may also be employed. Specific organic pigments and colors are exemplified as follows.

As pigments for magenta or red, for example, C.I. pigment red 2, C.I. pigment red 3, C.I. pigment red 5, C.I. pigment red 6, C.I. pigment red 7, C.I. pigment red 15, C.I. pigment red 16, C.I. pigment red 48:1, C.I. pigment red 53:1, C.I. pigment red 57:1, C.I. pigment red 122, C.I. pigment red 123, C.I. pigment red 139, C.I. pigment red 144, C.I. pigment red 149, C.I. pigment red 166, C.I. pigment red 177, C.I. pigment red 178, C.I. pigment red 222 or the like can be listed.

As pigments for orange or yellow, for example, C.I. pigment orange 31, C.I. pigment orange 43, C.I. pigment yellow 12, C.I. pigment yellow 13, C.I. pigment yellow 14, C.I. pigment yellow 15, C.I. pigment yellow 17, C.I. pigment yellow 93, C.I. pigment yellow 94, C.I. pigment yellow 138, C.I. pigment yellow 180, C.I. pigment yellow 185, C.I. pigment yellow 155, C.I. pigment yellow 156 or the like can be listed.

As pigments for green or cyanogen, for example, C.I. pigment blue 15, C.I. pigment blue 15:2, C.I. pigment blue 15:3, C.I. pigment blue 16, C.I. pigment blue 60, C.I. pigment green 7 or the like can be listed.

Further, as colors, for example, C.I. solvent red 1, C.I. solvent red 49, C.I. solvent red 52, C.I. solvent red 58, C.I. solvent red 63, C.I. solvent red 111, C.I. solvent red 122, C.I. solvent yellow 19, C.I. solvent yellow 44, C.I. solvent yellow 77, C.I. solvent yellow 79, C.I. solvent yellow 81, C.I. solvent yellow 82, C.I. solvent yellow 93, C.I. solvent yellow 98, C.I. solvent yellow 103, C.I. solvent yellow 104, C.I. solvent yellow 112, C.I. solvent yellow 162, C.I. solvent blue 25, C.I. solvent blue 36, C.I. solvent blue 60, C.I. solvent blue 70, C.I. solvent blue 93, C.I. solvent blue 95 can be employed, and mixtures thereof can also be employed.

One of these organic pigments and colors can be selected alone to be employed, or the combination of these organic pigments and colors can be simultaneously employed, as desired. Further, the quantity of addition of the pigments may be 2 to 20 mass % over polymer, and preferably 3 to 15 mass % may also be selected.

Colorants (colorant particles) composing the toner may be surface-reformed. As surface reforming agents, conventionally a known surface reforming agents can be used, and more specifically, silane coupling agents, titanium coupling agents, aluminum coupling agents or the like may preferably be employed. Silane coupling agent may include, for example, alkoxysilanes such as methyl trimethoxysilane, phenyltrimethoxysilane, methylphenyldimethoxysilane, of diphenyldimethoxysilane or the like, siloxane such as hexamethyldisiloxane or the like, γ-chloropropyltrimethoxysilane, vinyltrichlorosilane, vinyltrimethoxysilane, vinyltriethoxysilane, γ-methacryloxypropyltrimethoxysilane, γ-glycidoxypropyltrimethoxysilane, γ-mercaptopropyltrimethoxysilane, γ-aminopropyltriethoxysilane, γ-ureidepropyltriethoxysilane or the like. Titanium coupling agent may include, for example, TTS, 9S, 38S, 41B, 46B, 55, 138S, 238S, with the brand name of "PLENACT" commercialy available from Ajinomoto Co., Ltd., and A-1, B-1, TOT, TST, TAA, TAT, TLA, TOG, TBSTA, A-10, TBT, B-2, B-4, B-7, B-10, TBSTA-400, TTS, TOA-30, TSDMA, TTAB, TTOP, commercially available from Nippon Soda Co., Ltd. Aluminum coupling agents may include, for example, "PLENACT AL-M", commercially available from Ajinomoto Co., Ltd.

The quantity of adding of these surface reforming agents may preferably be 0.01 to 20 mass % over the colorant, and more preferably 0.1 to 5 mass %.

The surface reforming methods for the colorant particles may include a method for adding the surface reforming agent into the dispersion liquid of colorant particles, and heating the system to induce a reaction.

The surface reformed colorant particles are recovered via the filtration processing, and after the cleaning processing and the filtration processing with using the same solvent are repeated, these are dry processed.

(Mold Releasing Agent)

The toner used for the present invention may be preferably be the toner, which is formed by fusing the resin particles containing the mold releasing agent therein within the water type medium. As such, the toner having the mold releasing agent finely dispersed therein can be obtained by salting out/fusing the resin particles containing the mold releasing agent within the resin particles with the colorant particles in the water type and medium.

For the toner according to the present invention, low molecular weight polypropylene (number average molecular weight=1,500 to 9,000) and low molecular weight polyethylene are preferable the for the mold releasing agent, and the ester compounds shown as the following formula are particularly preferable.

$$R^1—(OCO—R^2)n$$

In the formula, n represents an integer number of 1 to 4, preferably 2 to 4, more preferably 3 to 4, and particularly preferably 4. $R^1$ and $R^2$ represent hydrocarbon groups, each of which may have substituent. $R^1$ has 1 to 40 carbons, preferably 1 to 20 carbons, and more preferably 2 to 5 carbons. $R^2$ has 1 to 40 carbons, preferably 16 to 30 carbons, and more preferably 18 to 26 carbons.

Next, examples of the typical compounds will be shown below.

[Chemical Formula 3]

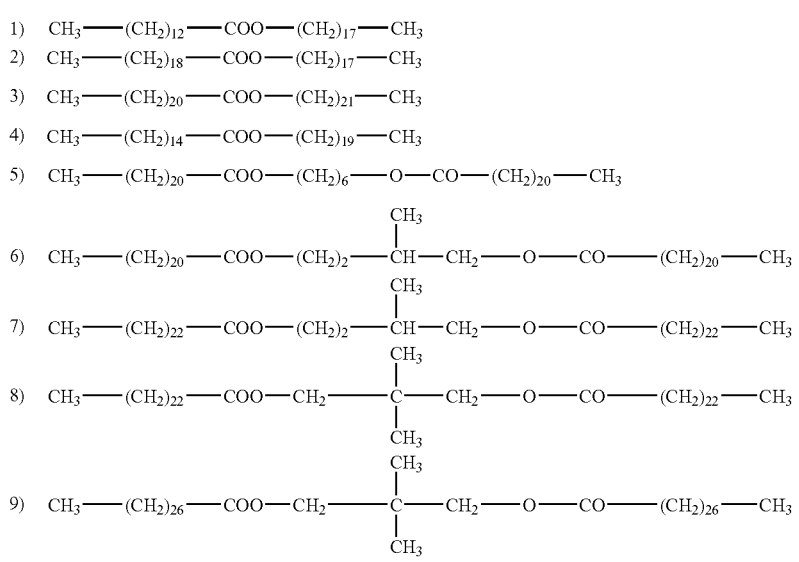

-continued

10) $CH_2—O—CO—(CH_2)_{26}—CH_3$
$CH—O—CO—(CH_2)_{26}—CH_3$
$CH_2—O—CO—(CH_2)_{26}—CH_3$

11) $CH_2—O—CO—(CH_2)_{22}—CH_3$
$CH—O—CO—(CH_2)_{22}—CH_3$
$CH_2—O—CO—(CH_2)_{22}—CH_3$

12) $CH_2—OH$
$CH—O—CO—(CH_2)_{26}—CH_3$
$CH_2—O—CO—(CH_2)_{26}—CH_3$

13) $CH_2—OH$
$CH—O—CO—(CH_2)_{22}—CH_3$
$CH_2—O—CO—(CH_2)_{22}—CH_3$

14) $CH_2—OH$
$CH—OH$
$CH_2—O—CO—(CH_2)_{26}—CH_3$

15) $CH_2—OH$
$CH—OH$
$CH_2—O—CO—(CH_2)_{22}—CH_3$

[Chemical Formula 4]

16)

$$CH_3—(CH_2)_{26}—COO—CH_2—C(CH_3)(CH_2—O—CO—(CH_2)_{26}—CH_3)(CH_2—O—CO—(CH_2)_{26}—CH_3)$$

17)

$$CH_3—(CH_2)_{20}—COO—CH_2—C(CH_2CH_3)(CH_2—O—CO—(CH_2)_{20}—CH_3)(CH_2—O—CO—(CH_2)_{20}—CH_3)$$

18)

$$CH_3—(CH_2)_{26}—COO—CH_2—C(CH_2—O—CO—(CH_2)_{26}—CH_3)(CH_2—O—CO—(CH_2)_{26}—CH_3)(CH_2—O—CO—(CH_2)_{26}—CH_3)$$

19)

$$CH_3—(CH_2)_{20}—COO—CH_2—C(CH_2—O—CO—(CH_2)_{20}—CH_3)(CH_2—O—CO—(CH_2)_{20}—CH_3)(CH_2—O—CO—(CH_2)_{20}—CH_3)$$

20)

$$CH_3—(CH_2)_{18}—COO—CH_2—C(CH_2—O—CO—(CH_2)_{18}—CH_3)(CH_2—O—CO—(CH_2)_{18}—CH_3)(CH_2—O—CO—(CH_2)_{18}—CH_3)$$

21)

$$CH_3—(CH_2)_{16}—COO—CH_2—C(CH_2—O—CO—(CH_2)_{16}—CH_3)(CH_2—O—CO—(CH_2)_{16}—CH_3)(CH_2—O—CO—(CH_2)_{16}—CH_3)$$

22)

-continued $$CH_3—(CH_2)_{20}—COO—CH_2—C(CH_2—O—CO—CH_3)(CH_2—CH_2—O—CO—CH_3)(CH_2—O—CO—CH_3)$$

The quantity of adding the above compound may be 1 to 30 mass % over the whole toner, preferably 2 to 20 mass %, and more preferably 3 to 15 mass %.

The toner according to the present invention may preferably prepared by incorporating the above-described mold releasing agent within the resin particles via the mini-emulsion polymerization method, and salting out/fusing them with the toner particle.

(Charge Control Agent)

Toner can include additional materials, which can provide various kinds of functions as the toner materials other than the colorants and mold releasing agents. More specifically, charge control agents can be added thereto. These components can be added via various methods such as a method of incorporating the resin particles and the colorant particles by simultaneously adding the resin particles and the colorant particles at the stage of the above-mentioned salting out/fusing stage, a method of adding thereof to the resin particles themselves or the like.

Various known charge control agent capable of being dispersed in the water can be employed. More specifically, nigrosine type colors, metal salts of naphthenic acid or higher fatty acid, amine alkoxylate, quaternary ammonium salt compounds, azo metallic complexes, salicylic acid metal salts, or the metallic complexes thereof may be illustrated.

(External Addition Agent)

So-called external addition agent may be added to the toner according to the present invention for using the toner, in order to improve the flowability and improve the cleaninability. These external addition agents are not particularly limited, and various inorganic fine particles, organic fine particles and lubricants can be used.

As the inorganic fine particles available as the external addition agents, conventionally known external addition agents can be illustrated. More specifically, silica fine particle, titanium fine particle, alumina fine particle or the like can be employed. These inorganic fine particles are preferably hydrophobic.

Specific examples of the silica fine particles may be R-805, R-976, R-974, R-972, R-812 and R-809 commercially available from Japan Aerosil Co., Ltd., HVK-2150 and H-200 commercially available from Hoechst, TS-720, TS-530, TS-610, H-5 and MS-5 commercially available from Cabot and so on.

Specific examples of titanium fine particles may be, for example, T-805 and T-604 commercially available from Japan Aerosil Co., Ltd., MT-100S, MT-100B, MT-500BS, MT-600, MT-600SS and JA-1, commercially available from Tayca Corp., TA-300SI, TA-500, TAF-130, TAF-510 and TAF-510T, commercially available from Fuji titanium Co., Ltd., IT-S, IT-OA, IT-OB and IT-OC, commercially available from Idemitsu Kosan Co., Ltd. or the like.

Specific examples of alumina fine particles may be, for example, RFY—C and C-604 commercially available from Japan Aerosil Co., Ltd., TTO-55 commercially available from Ishihara Sangyo Kaisha or the like.

Organic fine particles usable for the external addition agents may include spherical fine particles having a number average primary particle diameter of 10 to 2,000 nm level. The materials composing the organic fine particles may include polystyrene, olymethylmethacrylate, styrene-methylmethacrylate copolymer or the like.

The lubricants usable for the external addition agent may include metal salts of higher fatty acid. Specific examples of metal salts of higher fatty acid may be: metal stearate such as zinc stearate, aluminum stearate, copper stearate, magnesium stearate, calcium stearate or the like; metal salt oleate such as zinc oleate, manganese oleate, iron oleate, copper oleate, magnesium oleate or the like; metal palmitate such as zinc palmitate, copper palmitate, magnesium palmitate, calcium palmitate or the like; metal linoleate such as zinc linoleate, calcium linoleate or the like; metal ricinoleate such as zinc ricinoleate, calcium ricinoleate or the like.

The quantity of adding the external addition agent may preferably be 0.1 to 5 mass % level over the toner.

(Step of Adding External Addition Agent)

This step is a processing step, in which the external addition agent is added in the dry-processed toner particles.

Apparatus for using to add the external addition agents may include various known mixing equipment such as turbular mixer, henschel mixer, nauta mixer, V-type mixer or the like.

(Toner Particle)

Particle size of the toner may preferably be 3 to 10 μm as the number mean particle diameter, and more preferably 3 to 8 μm. The particle size can be controlled by adjusting the concentration of the flocculant (salting out agent), the quantity of the added organic solvent, the fusing time and the composition of polymer, in the process for manufacturing toner.

Having the number mean particle diameter of 3-10 μm reduces the rate of the toner fine particles having larger adhesive force, which fly and are adhered to heating member to cause the offset in the fixing step, and further the transference efficiency increases, and the half-tone picture quality of improves and the picture quality in the filaments or dots improves.

Number mean particle diameter of the toner can be measured by utilizing coulter counter TA-II, coulter multisizer SLAD1100 (laser diffraction type particle size measuring apparatus, commercially available from Shimadzu Co., Ltd.) or the like.

In the present invention, the measurements were conducted by using the coulter multi-sizer, which is connected to an interface (commercially available from Nikkaki Co., Ltd.) that outputs the particle size distribution and to a personal computer. An aperture having a diameter of 100 μm was selected for the above-mentioned coulter multi-sizer to measure the volumetric distribution of toner of not smaller than 2 μm (for example, 2 to 40 μm), thereby calculating the particle size distribution and mean particle diameter thereof.

(Range of Preferable Shape Factor of Toner Particle)

The toner may contain equal to or more than 65 number % of the particles having the shape factor of 1.0 to 1.6, may preferably contain equal to or more than 65 number % of the particles having the shape factor of 1.2 to 1.6, and particularly preferably contain equal to or more than 70 number % of the particles having the shape factor of 1.2 to 1.6.

The shape factor of the toner is determined by the following formula, and presents a degree of roundness of the toner particle.

$$\text{Shape factor}=((\text{maximum diameter}/2)2\times\pi)/\text{projected area}$$

Here, the maximum diameter is determined to be a width of particle presented by a maximum space between parallel lines, when the projection image of the toner particle onto a plane is sandwiched with two parallel lines. The projection area is determined to be an area of the projection image of toner particle onto a plane. In the present invention, the shape factor was measured by picking up enlarged images of the toner particles magnified to 2000 times by utilizing a scanning electron microscope, and conducting an image analysis on the basis of the picked up enlarged images utilizing "SCANNING IMAGE ANALYZER" (commercially available from JEOL Co., Ltd.). In this occasion, 100 toner particles were used, and the shape factor of the present invention was measured with above formula for computation.

As the toner according to the present invention, it is preferable to be a toner, in which sum (M) of the relative frequency (m1) of the toner particles contained in the most frequent hierarchy and the relative frequency (m2) of the toner particles contained in the second most frequent hierarchy that is next to the most frequent hierarchy is equal to or more than 70%, provided that the hierarchies appear in a histogram showing the particle size distribution of the number standard, which is divided in the abscissa into a plurality of hierarchies by interval of 0.23, and natural logarithm ln(D) is taken in abscissa when the particle size of the toner particles is presented as D (μm).

Having the configuration, in which sum (M) of relative frequency (m1) and relative frequency (m2) is equal to or more than 70%, the variance of the size distribution of the toner particle becomes narrow, and therefore the prohibition of the generation of the selective development is ensured by employing the toner for the processing step of forming the image.

The histogram showing the size distribution of the above-described number standard is a histogram showing the size distribution of number standard, dividing the natural logarithm ln(D) (D: particle size of individual toner particle) into a plurality of hierarchies with intervals of 0.23 (0 to 0.23: 0.23 to 0.46: 0.46 to 0.69: 0.69 to 0.92: 0.92 to 1.15: 1.15 to 1.38: 1.38 to 1.61: 1.61 to 1.84: 1.84 to 2.07: 2.07 to 2.30: 2.30 to 2.53: 2.53 to 2.76 . . . ). This histogram is prepared by forwarding the measured particle size data of the sample according to the following condition by using a coulter multi-sizer via I/O unit to a computer, and operating a size distribution analysis program in the computer.

[Measurement Condition]

1: Aperture: 100 μm

2: Sample preparation method: an appropriate amount of a surfactant (neutral detergent) is added to 50 to 100 ml of electrolytic solution (ISOTON R-11 (commercially available from Coulter Scientific Japan Co., Ltd.)) and the mixture is stirred, and then 10 to 20 mg of the test sample is added. This system is dispersion-processed with an ultrasonic dispersion machine for one minute to prepare the sample.

(Developer)

The toner may be employed as either of one component developer or two component developer.

When the developer is employed as one component developer, the developer may include a nonmagnetic one component developer, or a magnetic one component developer prepared by incorporating magnetic particles of having diameters of 0.1 to 0.5 μm level in the toner, and either of these developers may be employed.

Further, these one component developers may be mixed with a carrier to prepare a two component developer. In this case, as the magnetic particle of carrier, conventionally known material including metals such as iron, ferrite, magnetite or the like, alloys with the above-described metals and metals such as aluminum, lead or the like can be employed. In particular, ferrite particles are preferable. The above-described magnetic particle may have a volumetric mean particle diameter of 15 to 100 μm, and more preferably 25 to 80 μm.

Measurements of the volumetric mean particle diameter of the carrier typically may be carried out by utilizing a laser diffraction particle size distribution measurement apparatus comprising a wet process disperser "HELOS" (commercially available from SYMPATEC Co., Ltd.).

As for the carrier, a carrier having magnetic particles coated with a resin, or a so-called resin distributed carrier, which is prepared by dispersing the magnetic particles in a resin, is preferable. The resin composition for the coating is not particularly limited, and the available resins for the use may include, for example, olefin type resins, styrene type resins, Styrene-acryl type resins, silicone type resins, ester type resins, or fluorine content polymer type resin or the like. Further, resins for composing the resin dispersing type carrier is not particularly limited and conventionally known resins, for example, styrene-acryl type resins, polyester resins, fluorine type resins, phenolic resins or the like, can be used.

(Image Forming Method)

The toner according to the present invention may suitably be employed for an image formation method, which comprises a step of fixing the image by passing an image formation base member having a toner image formed thereon between the heating roller 1 and the endless belt 2 that compose the fixing apparatus described in reference with FIGS. 1 and 2.

(Image Forming Method and Apparatus)

Figure 3:
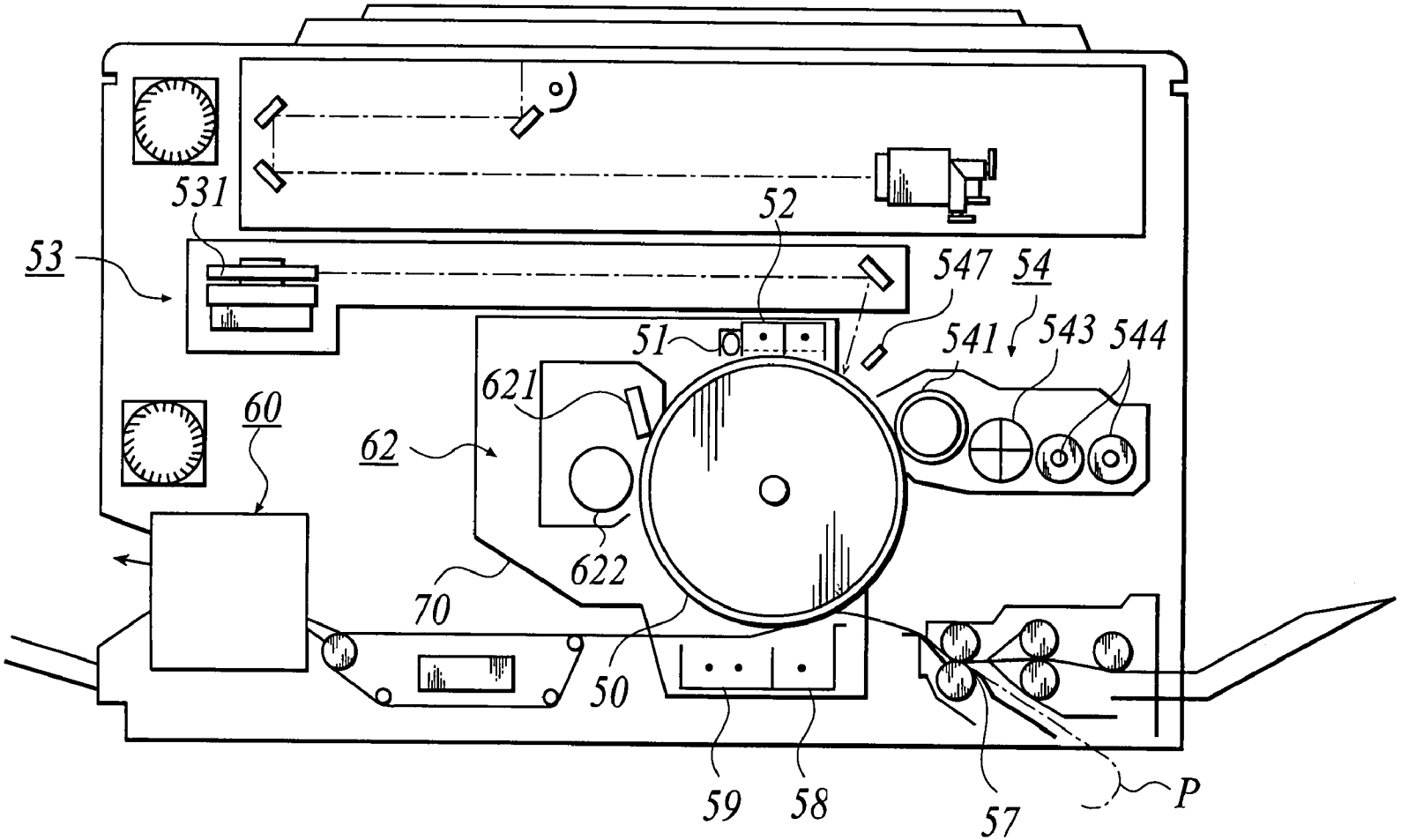
FIG. 3 is a sectional view diagrammatically illustrating an example of an image forming apparatus for carrying out the image forming method according to the invention.

FIG. 3 is a cross-sectional view of an example of an image forming apparatus for embodying the image forming method of the invention.

In FIG. 3, the reference numeral 50 denotes a photoreceptor drum (a photoreceptor) which is an image bearable body. The photoreceptor is prepared by applying an organic photosensitive layer onto the drum, and further by applying a resinous layer onto the resultant photosensitive layer. The drum is grounded and rotated clockwise. Reference numeral 52 is a scorotron charging unit (charging means) which uniformly charges the circumferential surface of photoreceptor drum 50 via corona discharge. Prior to charging, employing the charging unit 52, in order to eliminate the hysteresis of the photoreceptor due to the previous image formation, the photoreceptor surface may be subjected to charge elimination through exposure, employing a pre-charge exposure section 51 comprised of light emitting diodes.

After uniformly charging the photoreceptor, image exposure is carried out based on image signals employing an image exposing unit 53. The image exposing unit 53 comprises a laser diode (not shown) as the exposure light source. Scanning onto the photoreceptor drum is carried out employing light of which light path has been deflected by a reflection mirror through a rotating polygonal mirror 531, fθ lens, and the like, and thus an electrostatic latent image is formed thereon.

The reversal developing process in this invention is an image formation method in which the surface of the photoreceptor is uniformly charged by the charging unit 52, and a portion on which image exposure is carried out, that is, an exposed portion potential of the photoreceptor (image exposed portion) is developed through a developing process (method). A non-image exposed portion is not developed since developing bias potential is applied to the photoreceptor by a developing sleeve 541.

The resultant electrostatic latent image is subsequently developed in the development unit 54. The development unit 54, which stores the developer material comprised of a carrier and a toner, is disposed adjacent to the outer peripheral surface of the photoreceptor drum 50. The development is carried out employing the development sleeve 541, internally comprises magnets and rotates while bearing the developer material on its outer peripheral surface. The interior of the developer unit 54 comprises a developer material stirring member 544, a developer material conveying member 543 and a conveying amount regulating member. Thus, the developer material is stirred, conveyed and supplied to the development sleeve. The supply amount is controlled by the conveying amount regulating member. The conveyed amount of the developer material varies depending on the linear speed of an applied organic electrophotographic photoreceptor as well as its specific gravity, but is commonly in the range of 20 to 200 mg/cm$^2$.

The amount of the developer material is regulated employing the conveying amount regulating member, and then conveyed to the development zone, where the latent image developed therewith. At that time, development may be carried out while direct current bias voltage, if desired, alternative current bias voltage is applied to the space between photoreceptor drum 50 and development sleeve 541. In this case, the developer material is subjected to development in a contact or non-contact state with the photoreceptor. The potential of the photoreceptor may be carried out above the developing zone by using a potential sensor 547.

A recording paper P is supplied to the transfer zone by the rotation of paper feeding roller 57, when timing for transfer is properly adjusted.

In the transfer zone, a transfer electrode (transfer section: transferring device) 58 provided adjacent to the peripheral surface of the photoreceptor drum 50 is activated in synchronous with the transferring timing to perform the image transfer onto the recording paper P which has been introduced between the photoreceptor drum 50 and the transfer electrode 58.

Subsequently, the resultant recording paper P is subjected to charge elimination, employing separation electrode (the separation unit) 59 which has been activated almost concurrently with activation of the transfer electrode 58. Thus, the recording paper P is separated from the circumferential surface of photoreceptor drum 50, and conveyed to a fixing unit 60. Then, after the toner is fused under heat and pressure, the resulting recording paper P is ejected to the exterior of the apparatus. Further, after passage of the recording paper P, the transfer electrode 58 and the separation electrode 59 are retracted from the circumferential surface of photoreceptor drum 50, and is prepared for the formation of subsequent toner images. In FIG. 3, a corotron electrode is used as the transfer electrode 58. The operating condition of the transfer electrode varies with the process speed (peripheral speed) of the photoreceptor drum 50 and are not specifically specified. Generally, however, the transfer current is in the range of, for example, +100 to +400 μA, and the transfer voltage is in the range of, for example, from +500 to +2,000 V.

On the other hand, the photoreceptor drum 50, from which recording paper P has been separated, is subjected to removal of any residual toner and cleaning through pressure contact with a blade 621 of a cleaning unit 62, and then subjected to charge elimination by precharge exposure section 51, as well as subjected to charging employing the charging unit 52. The photoreceptor drum 50 then enters the next image forming process.

Reference numeral 70 denotes a detachable process cartridge, which is integrally comprised of the photoreceptor, the charging unit, the transfer unit, the separation unit, and the cleaning unit.

The organic electrophotographic photoreceptor of the invention can generally be applied to electrophotographic apparatuses, laser printers, LED printers, liquid crystal shutter type printers, and the like, and can further be widely applied to apparatuses such as displays, recording media, small volume printing, plate making, facsimile production, and the like, to which common electrophotographic techniques are applied.

Concerning the fixing method, description has been made in reference to FIGS. 1 and 2 in detail before, and supplementary description on other features thereof will be made as follows.

A metal core 3 preferably has the inside diameter of 10 to 70 mm and also preferably has the wall thickness of 0.1 to 15 mm, and these are determined in consideration of the balance between the requirement for the energy saving (reduction of the wall thickness) and the requirement for the strength (depending upon the composing material). For example, in order to maintain strength equivalent to that of a core consisting of iron of 0.57 mm thick by utilizing a core metal consisting of aluminum, it is preferable to have the wall thickness of 0.8 mm.

The thickness of the fluorine resin layer composing the releasing layer 5 may be 10 to 500 μm, and preferably 20 to 400 μm. If the thickness of the releasing layer 5 is less than 10 μm, the functions as the releasing layer cannot be fully presented, and thus the durability as the fixing apparatus cannot be ensured. On the other hand, if 500 μm is exceeded, the heat conduction of the heating roller is reduced, and thus surface temperature of the roller cannot be uniformly controlled.

As the contacting load (total load) of the heating roller 1 with the pressure roller 6 may usually be 40 to 350 N, preferably 50 to 300 N, and more preferably 50 to 250 N. This contacting load is determined in consideration with the strength of the heating roller 1 (wall thickness of the core 3), and for example, it is preferable to determine equal to or less than 250N for the heating roller having the core consisting of iron of 0.3 mm thick.

Further, in view of the offset resistance and fixing properties, the nip width may be preferably 4 to 10 mm, and the bearing of the nip may preferable be $0.6\times10^5$ Pa to $1.5\times10^5$ Pa.

An example of the fixing condition for the fixing apparatus shown in FIGS. 1 and 2 may be that the fixing temperature (surface temperature of the heating roller 1) is 150 to 210 degree C., and the fixing linear velocity is 80 to 640 mm/sec.

The fixing apparatus for using in the present invention may be provided with a cleaning mechanism as required. In this case, available method is that silicone oil is supplied to the upper roller (heating roller) on the fixing member by the method of supplying a pad roller, web or the like impregnating silicone oil therein to clean thereof.

Available silicone oil may be a silicone oil having higher resistant to heat, and poly dimethylsiloxane, polyphenyl methylsiloxane, poly diphenyl siloxane or the like may be used. Since silicone oil having lower viscosity provides larger discharging flow in the operation, silicone oil having a viscosity of 1 to 100 Pa sec in 20 degree C. may preferably be employed.

Nevertheless, the advantageous effect of the present invention is considerably exhibited in particular in the case of having a step of forming an image by using a fixing apparatus, in which no silicone oil is supplied thereto or the quantity of feeding of silicone oil is extremely low. Accordingly, even if silicone oil is supplied therein, feeding quantity thereof may preferably be equal to or less than 2 mg per one A4 sheet paper.

By having a feeding quantity of silicone oil as equal to or less than 2 mg per one A4 sheet paper, the adhesion of silicone oil on the transfer paper (image support) after the fixing process is reduced, and the disturbance for the writing with an oiliness pen such as a ball point pen by the silicone oil adhered to transfer paper is reduced, and thus the writing-ability is not spoiled.

Further, a problem of the decrease of the offset resistance by time due to the decomposition of silicone oil, and a problem of contamination of the optical system and the charging pole by silicone oil can be prevented.

Here, a feeding quantity of silicone oil can be calculated by passing 100 sheets of the transfer papers (a blank paper of A4 size) in succession through the fixing apparatus (between rollers) which is heated to a predetermined temperature, and the variation in the mass ($\Delta w$) of the fixing apparatus before and after passing the paper sheets, and thus the feeding quantity is calculated ($\Delta w/100$).

The present invention will be described by illustrating examples more specifically as follows, and it is not intended that the present invention is limited to these examples.

((Preparation of Various Deodorizers))

According to the method described below, deodorizers 1 to 4 were prepared.

<Deodorizer 1: Deodorizer Containing Plant Extracted Component>

Deodorizer 1 was prepared by dissolving 10 g of F118 (commercially available from Fine 2 Co., Ltd.), which is a commercially available deodorizer containing plant extracted component, into 2 kg of ion-exchange water at 40 degree C.

<Deodorizer 2: Enzyme Type Deodorizer>

Deodorizer 2 was prepared by dissolving 5 g of Bio Dash P-500 (commercially available from Daiso Co., Ltd.) into 2 kg of ion-exchange water at 40 degree C.

<Deodorizer 3: Enzyme Type Deodorizer Containing Plant Extracted Component>

Deodorizer 2 was prepared by dissolving 5 g of Bio C (commercially available from Console Corporation), which is a commercially available deodorizer containing plant extracted component into 2 kg of ion-exchange water at 40 degree C.

<Deodorizer 4: Amyris Oil Type Deodorizer>

Deodorizer 4, which is an emulsion, was prepared by dispersing 2 g of amyris oil into 200 ml of ion-exchange water containing surfactant.

((Preparation of Toner and Developer))

(Preparation of Resin Particle)

[Preparation of Resin Particle 1HML]

<1: Preparation of Nuclear Particle (First Step of Polymerization)>

A surfactant solution (water type medium) containing 7.08 g of anionic type surfactant "A" ($C_{10}H_{21}$ $(OCH_2CH_2)_2$ $OSO_4Na$) dissolved in 3010 g of ion-exchange water was poured into a separable flask of 5000 ml, to which a stirrer, a temperature sensor, a cooling pipe and a nitrogen introduction unit were installed, and temperature was increased to 80 degree C. while stirring with agitation rate of 230 rpm and flowing nitrogen gas stream therein.

An initiator solution containing 9.2 g of polymerization initiator (potassium persulfate: KPS) dissolved in 200 g of ion-exchange water is added into this surfactant solution, and after increasing the temperature to 75 degree, a monomer liquid mixture composed of 70.1 g of styrene, 19.9 g of N-butylacrylate and 10.9 g of methacrylic acid was dropped for one hour, Polymerization (first step polymerization) is conducted by heating and stirring this system for two hours at 75 degree C. to prepare resin particles (a dispersion liquid of resin particles consisting of high molecular weight resin). These were assigned as "resin particle (1H)".

<2: Formation of Interlayer (Second Step Polymerization)>

98.0 g of the above-listed compound 19) as mold releasing agent was added in a monomer liquid mixture composed of 105.6 g of styrene, 30.0 g of N-butylacrylate, 15.4 g of methacrylic acid and 5.6 g of N-octyl-3-mercaptopropionate ester in a flask equipped with a stirrer, and heating and dissolving were conducted at 90 degree C. to prepare monomer solution 1. Subsequently, the surfactant solution containing 1.6 g of above-mentioned anionic surfactant "A" dissolved in 2700 ml of ion-exchange water is heated to 98 degree C., and after 28 g with solid content conversion of the above-mentioned resin particles (1H), which is the dispersion liquid of the nuclear particles, was added in this surfactant solution, the above-mentioned prepared monomer solution 1 is mixed and dispersed by using a stirring apparatus "CLEARMIX", that comprises a circulating path (commercially available from M-Technique Co., Ltd.) to prepare an emulsion which included emulsification particles having a uniformly dispersed particle diameter (284 nm).

Subsequently, an initiator solution containing 5.1 g of polymerization initiator (KPS) dissolved in 240 ml of ion-exchange water and 750 ml of Ion-exchange water were added into this emulsion, and polymerization (second step polymerization) was conducted by heating and stirring this system for 12 hours at 98 degree C. to obtain resin particles (a dispersion liquid of composite resin particle having a structure, in which the surface of the resin particles composed of high molecular weight resin was coated with medium molecular weight resin). These were assigned as "resin particle (1HM)".

The above-mentioned resin particles (1HM) were dried and were observed with scanning electron microscope, and particles (400 to 1,000 nm) comprising a main component of the above-listed compound 19) that was not surrounded by latex were observed.

<Formation of Outer Layer (Third Step Polymerization)>

The initiator solution containing 7.4 g of polymerization initiator (KPS) dissolved in 200 ml of ion-exchange water was added to the above-mentioned prepared resin particles (1HM), and a monomer liquid mixture composed of 300 g of styrene, 95 g of N-butylacrylate, 35.4 g of methacrylic acid and 10.4 g of N-octyl-3-mercaptopropionate ester was dropped thereto for one hour at a temperature condition of 80 degree C. After the dropping processing was completed, polymerization (third step polymerization) was carried out by heating and stirring for two hours, and thereafter the system was cooled to 28 degree C. to obtain resin particles (a dispersion liquid of composite resin particles comprising cores consisting of high molecular weight resin, inter-layers consisting of medium molecular weight resin, and outer layers consisting of low molecular weight resin, and the above-listed compound 19) is contained in the interlayer as mold releasing agent). These resin particles were assigned as "resin particle (1HML)".

The composite resin particles composing the resin particles (1HML) has a molecular weight distribution having the peak molecular weights at 138,000, 78,000 and 14,500, and the mass mean particle diameter of the composite resin particles was 124 nm.

[Preparation of Resin Particle (2HML)]

Resin particles (a dispersion liquid of composite resin particles having cores consisting of high molecular weight resin, inter-layers consisting of medium molecular weight resin and outer layers consisting of low molecular weight resin) were prepared by process similar to the preparation process of the above resin particle (1HML), except that the adding quantity of methacrylic acid for the formation of interlayer (the second step polymerization) was changed from 15.4 g to 10.5 g, and except that, furthermore in formation of the outer layer (third step polymerization), the adding quantity of methacrylic acid was changed from 35.4 g to 18.5 g. These resin particles were assigned as "resin particle (2HML)".

The composite resin particles composing the resin particles (2HML) has a molecular weight distribution having the peak molecular weights at 118,000, 80,000 and 13,500, and the mass mean particle diameter of the composite resin particles was 110 nm.

(Preparation of Toner)

[Preparation of Toner Particles]

<Preparation of Toner Particles 1 to 4>

59.0 g of anionic system surfactant "B" (sodium dodecyl sulfate) was added to 1600 ml of ion-exchange water and was stirred and dissolved. While stirring this solution, 420.0 g of carbon black "Legal 330" (commercially available from Cabot Co., Ltd.) was gradually added, and subsequently, a dispersion liquid of colorant particles (hereinafter called "colorant dispersion liquid 1") was prepared by conducting a dispersion processing using "CLEARMIX" (commercially available from M-Technique Co., Ltd.). A particle diameter of the colorant particles in the colorant dispersion liquid 1 was measured using an electrophoretic light scattering photometer "ELS-800" (commercially available from Otsuka Electronics Co., Ltd.), and the result was 98 nm by mass mean particle diameter.

420.7 g (solid content conversion) of the aforementioned prepared resin particles (1HML), 900 g of ion-exchange water and 166 g of the above prepared colorant dispersion liquid 1 were added into a reactor vessel (four neck flask) equipped with a temperature sensor, a cooling pipe, a nitrogen introduction apparatus and a stirring apparatus, and was stirred. After adjusting the temperature in the vessel at 30 degree C., 5 mol/l of sodium hydroxide aqueous solution was added to this solution, and pH was adjusted to 9.0.

Subsequently, a step of adding water solution containing respective flocculants dissolved in 1000 ml of ion-exchange water by combinations described in table 2 was continued for 10 minutes while stirring thereof at 30 degree C. After leaving thereof for three minutes, temperature rising was started, and the temperature of this aqueous solution was increased for 30 minutes up to 90 degree C. to start the growth of the particles. The particle size of the associated particles were measured by utilizing "Coulter counter TA-II", while maintaining this condition, and when the detected volumetric mean particle diameter was 4.0 μm, the water solution containing terminators listed in Table 2 dissolved in 1000 ml of ion-exchange water was added to stop the growth of the particles. Furthermore, heating and stirring thereof were continued as a maturing processing for 2 hours at a solution temperature of 98 degree C. to continue the fusing processing. Thereafter, the system was cooled down to 30 degree C. under the cooling condition of 8 degree C./minute. Subsequently, hydrochloric acid was added to adjust pH to 2.0, and the stirring was stopped. Generated associated particles were filtered by using a nutsche filter, and after repeatedly washed with ion-exchange water at 45 degree C., respective aforementioned prepared deodorizers were filtered through the nutsche filter with combinations shown in Table 2, and thereafter the filtered products were dried with a warm wind of 40 degree C. to prepare toner particles 1 to 4 of the present invention having components shown in Table 2.

<Preparation of Toner Particle 5 to 7>

Toner particle 5 to 7 were prepared by replacing the resin particles (1HML) with resin particles (2HML), and further changing the types and the adding quantities of the flocculants and the terminators and types of deodorizers as described in Table 2, from the preparation processes of above-described toner particle 1 to 4.

<Preparation of Comparative Toner Particles 1>

55 parts by mass of polymer consisting of styrene and acrylic acid and having a peak at 3,000 in the molecular weight distribution, 20 parts by mass of polymer consist of styrene, butylacrylate and acrylic acid and having a peak at 100,000 in the molecular weight distribution and 25 parts by mass of polymer consisting of styrene and butylacrylate having a peak at 650,000 in the molecular weight distribution were uniformly blended in xylene. Xylene was removed by distillation at the reduced pressure, and the binder resin 1 was obtained.

100 parts by mass of the binder resin 1, 10 parts by mass of carbon black and 4 parts by mass of polypropylene wax were melted and kneaded by using a dual axis roll kneader, and thereafter, the kneaded compound was pulverized by using a jet mill. Subsequently, toner compound having a volumetric mean particle diameter of 8.5 μm was obtained by using an air classification apparatus. 1 part by mass of hydrophobic silica was added over 100 parts by mass of this toner composition and was mixed by using a dry mixer to obtain comparative toner particle 1.

As results of the measurements of molecular weight distribution of this comparative toner particle 1 by utilizing gel permeation chromatography, the chromatogram had a profile having a main peak at molecular weight of 3,000, a peak at molecular weight of 500,000 and a shoulder at molecular weight of around 130,000. Low molecular weight component (LP) was 63 mass %, medium molecular weight component (MP) was 20 mass %, high molecular weight component (HP) was 17 mass %, and [Mpratio+2×HPratio] was 54 mass %. Further, the results of the measurement of the glass transition point of this comparative toner particle 1 presented that the glass transition temperature was 55 degree C.

Here, the measurements of the glass transition temperature was carried out by using DSC, and the glass transition temperature was defined as an intersecting point of the base line and the gradient of the endotherm peak. More specifically, a differential scanning calorimetry was employed, and the temperature was increased to 100 degree C., and left them for three minutes at the temperature, and thereafter was cooled off to the room temperature with a cooling rate 10 degree C./min. Then, when the measurement of this sample was conducted under the condition of the temperature increasing rate of 10 degree C./min, an intersecting point of an extended line of the base line providing values equal to or less than the glass transition temperature and a tangential line showing a maximum gradient between the rising edge of the peak and the summit of the peak was defined as a glass transition temperature. Measuring apparatus of DSC-7, commercially available from Perkin Elmer was employed.

TABLE 2

| Toner Particle No. | Resin Particle No. | Flocculants Types | Flocculants Adding Quantities (g) | Anticatalysts Types | Anticatalysts Adding Quantities (g) | Deodorizing Agent No. |
|---|---|---|---|---|---|---|
| 1 | 1 | Magnesium Chloride Hexahydrate | 12.1 | Sodium Chloride | 80.4 | 1 + 3 |
| 2 | 1 | Magnesium Chloride Hexahydrate | 24.2 | Sodium Chloride | 40.2 | 1 + 2 |
| 3 | 1 | Magnesium Chloride Hexahydrate | 7.5 | Sodium Chloride | 56.1 | 1 |
| 4 | 1 | Magnesium Chloride Hexahydrate | 12.1 | — | — | 1 |
| 5 | 2 | Calcium Chloride Hexahydrate | 36.1 | Sodium Chloride | 160.8 | 3 |
| 6 | 2 | Aluminum Chloride | 2.9 | Calcium Chloride | 4.0 | 4 |
| 7 | 2 | Aluminum Hydroxide | 9.2 | Sodium Chloride | 80.4 | 3 + 4 |

(Measurements of Metal Salts a, b Content in Each of Toner Particles and Methacrylic Acid Content)

Concerning each of the prepared toners described above, contents of metal salts a, b defined by claim 1 and claim 3 and contents of methacrylic acid were measured, and the obtained results are shown in Table 3.

In addition to above, measurements of contents of metal salts a, b in each toner were conducted by using a X-ray fluorescence analysis apparatus "System 3270" (commercially available from Rigaku Denki Kogyo Co., Ltd.) to measure the intensity of fluorescent X-ray emitted from metal species of inorganic salts (for example, calcium from calcium chloride) and the intensity of fluorescent X-ray of base corresponding thereof. Further, the content of methacrylic acid was obtained by utilizing thermal decomposition gas chromatography.

TABLE 3

| Toner No. | Metallic Salt Contents a(%) | Metallic Salt Contents b(%) | Metallic Salt Contents a/b | Metallic Salt Corresponding to a | Metallic Salt Corresponding to b | Contents of Monomer Containing Carboxyl Group (%) |
|---|---|---|---|---|---|---|
| 1 | 0.71 | 0.49 | 1.45 | Magnesium Chloride | Sodium Chloride | 9 |
| 2 | 1.42 | 0.26 | 5.46 | Magnesium Chloride | Sodium Chloride | 9 |
| 3 | 0.44 | 0.36 | 1.22 | Magnesium Chloride | Sodium Chloride | 9 |
| 4 | 0.75 | — | — | Magnesium Chloride | Sodium Chloride | 6 |
| 5 | 1.87 | 0.94 | 1.99 | Calcium Chloride | Sodium Chloride | 6 |
| 6 | 0.12 | 0.02 | 6.00 | Aluminum Chloride | Calcium Chloride | 6 |
| 7 | 0.44 | 0.39 | 1.13 | Aluminum Hydroxide | Sodium Chloride | 9 |
| Comparative Toner 1 | — | — | — | — | — | 0 |

(Preparation of Developer)

As a developer, silicone coat carrier having a volumetric mean particle diameter of 60 μm was used, and was mixed with respective toners so that the toner concentration could be 6%.

((Image Formation and Evaluation of formed image))

(Image Formation)

As a belt for pressurization, an object was formed by coating a rubber composition disclosed in Example 2 of JP-Tokukai 2001-60050 on a base member having an endless belt-shape made of polyimide to a thickness of 200 μm, and baking thereof at a temperature of 230 degree C. for three hours to form an elastic body layer 14 as shown in FIG. 2.

A fixing unit shown in FIG. 2 was equipped with a halogen lamp of 800 W as an exothermic body 10 in the interior of a heating roller 1, and the processing conditions were set to: surface temperature of heating roller of 170 degree C., fixing speed of 220 mm/sec. and nip width of 10 mm. Further, a mold releasing agent application device for supplying mold releasing agent oil was provided on the surface of the heating roller. Unfixed toner images were introduced into the nip region formed by the heating roller 1 and the endless belt 2 and was passed therethrough, and each of the printed toner images on the base member by heat and pressure was fixed, and the fixing condition thereof were evaluated according to the following evaluations. Here, the toner density of the unfixed toner image was 1.5 mg/cm$^2$.

<Measurement of Range of Temperatures Available for Toner Fix>

Temperature of fixing roll was changed by 10 degrees pitch within the range of 130 degree C. to 240 degree C. to provide the fixed images. Here, general paper of A4 size (grammage: 64 g/m$^2$) was used for the use in the output of the fixed image.

The fixing strength of the obtained fixed image was evaluated by a method according to the mending tape-peeling method described in "Denshishashin Gijutu No Kisoto Ohyoh ("Basics and Applications of The Electrophotography Technology): edited by the Japanese Electrophotography Institute, chapter 9 sub section 1.4", and the fixing rate was evaluated. More specifically, after preparing a solid fixed image of 2.54 cm-square having a adhesion quantity of each toner of 0.6 mg/cm$^2$, and image concentrations before and after the peeling by using a scotch mending tape (commercially available from Sumitomo 3M Co., Ltd.) to determine the remaining rate of the image concentration as the fixing rate. In measurement of image concentration, reflecting density indicator RD-918 commercially available from Macbeth Co., Ltd. was used, and the temperature available for toner fix was defined as the fixing temperature, at which the fixing rate of equal to or higher than 95% was obtained.

Concerning the temperatures available for toner fix measured by the above-mentioned method, the ranges of temperatures available for toner fix were classified according to the criteria shown below.

◎(Excellent): range of temperature available for toner fix was equal to or more than 100 degree C.;

○(good): range of temperature available for toner fix was equal to or higher than 70 degree C. and less than 100 degree C.;

Δ(possible practical use): range of temperature available for toner fix was equal to or higher than 40 degree C. and less than 70 degree C.; and X(failure): range of temperature available for toner fix is less than 40 degree C.

<Evaluation of Offset Resistance>

After the printing processes were continuously carried out for 1,000 pieces of the A4 size transfer paper using each toner, a blank paper is printed, and the stain created on the blank paper due to the offset and the toner stain of the fixing member surface were observed with a visual observation. Here, heavy paper of the premium grade paper of 200 g/m$^2$ was used as the transfer paper, and a line image of 0.3 mm wide and 150 mm long, which is parallel in paper advance direction (heating roller periphery direction), was formed, and the offset natures were evaluated according to the criteria described below.

◎: Both the image offset and the toner stain of the heating roller were not recognized at all;

○: The image offset was not be confirmed, but the toner stain was recognized on the heating roller; and X: Image offset was clearly confirmed.

In above classifications, ◎ and ○ was judged that the practical use was possible, and X was judged that the practical use was not possible.

<Evaluation of Duration Life of Fixing Member>

It continuous printing was carried out under the condition described above, and the scale of the duration life of the fixing member was presented by the criteria of the number of processed sheets: in which the toner clagged on the endless belt or on the surface of the heating roller so that the it was impossible to clean thereof; or in which the image failure due to being peeled off begun to be detected on endless belt or the releasing layer of heating roller surface.

<Evaluation of Odor in Toner Fixing>

Evacuation filter was detached, and charts having image area of 7% were continuously printed for 1,000 sheets with each toner, using an electrophotographic apparatus having a fixing unit shown in FIG. 2, and concerning the fixing odor of the case, the odor was judged by 20 general panelists according to the following criteria.

◎: odor was hardly recognized;

○: odor was recognized inconsiderably, but there is not a feeling of unpleasantness in particular;

X: odor with an unpleasant feeling was recognized.

The obtained results according to above are shown in Table 4.

TABLE 4

| Toner No. | Range of Temperatures Available for Toner Fix | Anti-Offset | Lifetime of Fixing Material | Odor Generation for Fixing Process | Miscellaneous |
|---|---|---|---|---|---|
| 1 | ◎ | ◎ | 200,000 sheets | ◎ | Present Invention |
| 2 | ○ | ◎ | 180,000 sheets | ◎ | Present Invention |
| 3 | ◎ | ◎ | 180,000 sheets | ◎ | Present Invention |
| 4 | ○ | ○ | 100,000 sheets | ○ | Present Invention |
| 5 | ○ | ○ | 180,000 sheets | ○ | Present Invention |
| 6 | ○ | ○ | 160,000 sheets | ○ | Present Invention |
| 7 | ○ | ○ | 150,000 sheets | ○ | Present Invention |
| Comparative Toner 1 | X | X | 30,000 sheets | X | Comparative Example |

As can be seen from Table 4, in the fixing method utilizing the heating fixing device having the endless belt capable of orbitally moving and the elastic body layer formed on the endless belt, by employing the toner which employs the polymer toner particles containing the deodorizer according to the present invention, better range of temperature available for toner fix, and better the offset resistance than the comparative example are provided, long duration life of the fixing member is provided and the odor is hardly emitted in the toner fixing process.

What is claimed is:

1. An image forming method comprising:

fixing an image formed by a toner on a record sheet in a nip area formed by a pressurizing member which is contacted against a rotatable heating fixing member having an elastic body layer formed on an endless periphery surface capable of orbitally moving and which creates locally a large distortion in the elastic body layer in vicinity of outlet thereof, wherein the toner includes at least two metal salts having different valence and has a relationship given by the Formula (1).

$$2.0 \geqq a \geqq 0.1$$

$$1.0 \geqq b \geqq 0.01$$

$$7.5 \geqq a/b \geqq 1.1 \qquad \text{Formula (1)}$$

wherein a (mass %) is defined as a content of a metal salt which is contained at a highest content in total toner mass and b (mass %) is defined as a content of a metal salt which is contained at a second-highest content in the total toner mass, and mass values of a and b represent anhydride reduced values.

2. The image forming method of claim 1, wherein a surface layer of the rotatable heating fixing member comprises a vulcanizate of a fluorine-containing rubber, which contains 3 to 50 parts by mass of lower molecular weight-tetra ethylene fluoride resin fine particles or polyfluoroalkylvinylether (PFA) resin fine particle per 100 parts by mass of fluorine-containing rubber.

3. The image forming method of claim 2, wherein the surface layer of the rotatable heating fixing member is provided with a polyfluoroalkylvinylether layer on a surface of a silicone rubber.

4. The image forming method of claim 1, further comprising: forming an electrostatic latent image on an image support member and developing the electrostatic latent image formed on the image support member, with the toner.

5. The image forming method of claim 1, further comprising: feeding the record sheet having the toner image transferred into the nip area.

6. The image forming method of claim 1, wherein the nip area is formed by a heating member and the rotatable heating fixing member.

7. An image forming method comprising:

fixing an image formed by a toner on a record sheet in a nip area formed by a pressurizing member which is contacted against a rotatable heating fixing member having an elastic body layer formed on an endless periphery surface capable of orbitally moving and which creates locally a large distortion in the elastic body layer in vicinity of outlet thereof, wherein the toner is manufactured by salting out/fusing resin particles, wherein the toner is prepared by forming toner particles contained in the toner in a water based medium and eliminating odor, wherein the toner includes at least two metal salts having different valence and has a relationship given by the Formula (1):

$$2.0 \geqq a \geqq 0.1$$

$$1.0 \geqq b \geqq 0.01$$

$$7.5 \geqq a/b \geqq 1.1 \qquad \text{Formula (1)}$$

wherein a (mass %) is defined as a content of a metal salt which is contained at a highest content in total toner mass and b (mass %) is defined as a content of a metal salt which is contained at a second-highest content in the total toner mass, and mass values of a and b represent anhydride reduced values.

8. An image forming method comprising:

fixing a toner image on a recording sheet by passing the recording sheet in a nip area formed by a heating member and a fixing belt capable of orbitally moving, wherein, the fixing belt is pressed by pressurizing members from inside the orbitally moving so as to form the nip area between the pressurizing members, wherein the toner includes at least two metal salts having different valence and has a relationship given by the Formula (1)

$$2.0 \geqq a \geqq 0.1$$

$$1.0 \geqq b \geqq 0.01$$

$$7.5 \geqq a/b \geqq 1.1 \qquad \text{Formula (1)}$$

wherein a (mass %) is defined as a content of a metal salt which is contained at a highest content in total toner mass and b (mass %) is defined as a content of a metal salt which is contained at a second-highest content in the total toner mass, and mass values of a and b represent anhydride reduced values.

9. The image forming method of claim 8, wherein a surface layer of the fixing belt comprises a vulcanizate of a fluorine-containing rubber, which contains 3 to 50 parts by mass of lower molecular weight-tetra ethylene fluoride resin fine particles or polyfluoroalkylvinylether (PFA) resin fine particle per 100 parts by mass of fluorine-containing rubber.

10. The image forming method of claim 9, wherein the surface layer is provided with a polyfluoroalkylvinylether layer on a surface of a silicone rubber.

11. The image forming method of claim 8, wherein the fixing belt is contact to the heating member so that the fixing belt is wound up by the heating member.

12. The image forming method of claim 8, wherein the heating member has an elastic layer and one of the pressurizing members is disposed in the upstream side of the transporting direction of the record sheet, presses against the endless belt at a point where the endless belt makes contact with the heating member, and said one of said pressurizing members comprises a layer which is softer than the elastic layer of the heating member.

13. The image forming method of claim 8, further comprising:

rotating the heating member, wherein the fixing belt is driven to rotate at almost the same speed.

14. The image forming method of claim 8, wherein the heating member is a heating roller.

* * * * *